US011161345B2

(12) United States Patent
Furukawa et al.

(10) Patent No.: US 11,161,345 B2
(45) Date of Patent: Nov. 2, 2021

(54) INKJET RECORDING APPARATUS

(71) Applicant: KYOCERA Document Solutions Inc., Osaka (JP)

(72) Inventors: Noriaki Furukawa, Osaka (JP); Takashi Somete, Osaka (JP); Chikara Ishihara, Osaka (JP); Hiroyuki Ueda, Osaka (JP); Hiroomi Nakatsuji, Osaka (JP); Issei Nakano, Osaka (JP); Aiichiro Otana, Osaka (JP); Jun Nakano, Osaka (JP); Yasutaka Inui, Osaka (JP); Takuma Araki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 1 day.

(21) Appl. No.: 16/885,117

(22) Filed: May 27, 2020

(65) Prior Publication Data

US 2020/0376845 A1 Dec. 3, 2020

(30) Foreign Application Priority Data

May 30, 2019 (JP) ..... JP2019-101520
May 30, 2019 (JP) ..... JP2019-101521

(51) Int. Cl.
*B41J 2/165* (2006.01)

(52) U.S. Cl.
CPC .. *B41J 2/16552* (2013.01); *B41J 2002/16555* (2013.01); *B41J 2002/16558* (2013.01); *B41J 2002/16591* (2013.01)

(58) Field of Classification Search
CPC ..... B41J 2/16552; B41J 2002/16558; B41J 2002/16591; B41J 2002/16555; B41J 2/16526; B41J 2/16538; B41J 2/16544; B41J 2/16585
See application file for complete search history.

(56) References Cited

U.S. PATENT DOCUMENTS

2018/0154640 A1 6/2018 Furukawa et al.

FOREIGN PATENT DOCUMENTS

JP 2018-089829 A 6/2018

*Primary Examiner* — Sharon Polk
(74) *Attorney, Agent, or Firm* — IP Business Solutions, LLC

(57) ABSTRACT

An inkjet recording apparatus includes a recording head, a wiper member, a cleaning liquid supply device, a cleaning liquid flow path, and a controller. The cleaning liquid flow path includes a vertical tubular member connected to the cleaning liquid supply device and extending upward, and a horizontal tubular member connected to an upper end of the vertical tubular member and extending in a horizontal direction. The controller extrudes a cleaning liquid in at least a part of the cleaning liquid flow path from a cleaning liquid supply port before control of a cleaning operation for wiping an ink ejection surface of the recording head, thereby performing control of an air bubble release operation of the cleaning liquid flow path.

10 Claims, 14 Drawing Sheets

Fig.10

| AIR BUBBLE RELEASE OPERATION | | CLEANING OPERATION | RESULTS |
|---|---|---|---|
| EXTRUSION AMOUNT OF CLEANING LIQUID [mL] | MAGNIFICATION A | EXTRUSION AMOUNT OF CLEANING LIQUID [mL] | |
| 4.0 | 1.0 | 1.5 | × |
| 3.6 | 0.9 | | ○ |
| 2.8 | 0.7 | | ○ |
| 2.0 | 0.5 | | ○ |
| 1.2 | 0.3 | | × |

Fig.11

| OVERALL SYSTEM AIR BUBBLE RELEASE OPERATION | | | | CLEANING OPERATION | RESULTS |
|---|---|---|---|---|---|
| EXTRUSION AMOUNT OF CLEANING LIQUID [mL] | MAGNI-FICATION B | NUMBER OF CONTROL OPERATION REPETITIONS | TOTAL EXTRUSION AMOUNT OF CLEANING LIQUID [mL] | EXTRUSION AMOUNT OF CLEANING LIQUID [mL] | |
| 30 | 1.5 | 1 | 30 | 1.5 | ○ |
| 20 | 1.0 | 1 | 20 | | × |
| | | 2 | 40 | | ○ |
| 14 | 0.7 | 1 | 14 | | × |
| | | 2 | 28 | | × |
| | | 3 | 42 | | ○ |
| 10 | 0.5 | 1 | 10 | | × |
| | | 2 | 20 | | × |
| | | 3 | 30 | | ○ |
| 6 | 0.3 | 1 | 6 | | × |
| | | 2 | 12 | | × |
| | | 3 | 18 | | × |
| | | 4 | 24 | | × |
| | | 5 | 30 | | × |
| | | 6 | 36 | | × |

INKJET RECORDING APPARATUS

INCORPORATION BY REFERENCE

This application claims priority to Japanese Patent Application No. 2019-101520 and No. 2019-101521 filed on May 30, 2019, the entire contents of which are incorporated by reference here.

BACKGROUND

The present disclosure relates to an inkjet recording apparatus, and particularly, to a technology for cleaning an ink ejection surface of a recording head.

For example, there is an inkjet recording apparatus that records an image on a recording medium such as paper by ejecting ink onto the recording medium from a nozzle of a recording head. An ink column ejected from the nozzle of the recording head is divided into main droplets and very small droplets (that is, mist). Since this mist is greatly affected by air resistance or conveyance wind, the mist adheres to a nozzle surface of the recording head. When the adhered mist is water-based ink, the ink is gradually dried and firmly adheres to the nozzle surface. Therefore, it is difficult to completely remove the mist using a general cleaning method, that is, a cleaning method for extruding (purging) ink from a nozzle and then wiping a nozzle surface several times with a rubber wiper.

Therefore, there is an inkjet recording apparatus in which a cleaning liquid supply device including a cleaning liquid supply surface having a cleaning liquid supply port for supplying a cleaning liquid is provided upstream of a nozzle surface of a recording head in a wiping movement direction of a wiper, and a mechanism for wiping the nozzle surface using a wiper with the cleaning liquid from the cleaning liquid supply port after ink is purged from a nozzle is included. With this mechanism, mist adhered to the nozzle surface is removed by the nozzle surface being wiped using the wiper with the cleaning liquid.

SUMMARY

A causal relationship regarding occurrence of image defects due to paper stains with unknown causes was found through intensive research conducted by the inventors. For example, bubbles may be generated in a cleaning liquid inside a tube connected to a cleaning liquid supply port or air may enter the cleaning liquid. Since the cleaning liquid in the cleaning liquid supply port and the tube is supplied only in one direction, when the air enters the cleaning liquid supply port or the tube, the only way to remove the air is to extruding the air out. In a normal head cleaning operation, since an amount of cleaning liquid ejected from a cleaning liquid supply port is small, air bubbles cannot be completely released each time, occasional air bubbles become bubbles in the cleaning liquid supply port, and when a nozzle surface is wiped by a wiper with a cleaning liquid containing bubbles, the bubbles with a height are left at a position at which wiping has ended. When a height of a recording head and paper at the time of image formation is the smallest, the height is, for example, as small as 1.0 mm, and thus, it was found that air bubbles come into contact with the paper, causing image defects. Therefore, the inventors have conceived of a configuration for performing control of an air bubble release operation for releasing air bubbles inside a cleaning liquid flow path by extruding a cleaning liquid in the cleaning liquid flow path. It was found that control of the air bubble release operation is effective. Further, when the cleaning liquid flow path is formed of a vertical tubular member extending upward from a cleaning liquid supply device and a horizontal tubular member connected to an upper end of the vertical tubular member and extending in a horizontal direction, air bubbles can be separated by the vertical tubular member and the horizontal tubular member, and control conditions under which air bubble release control can be preferably realized while a supply amount of cleaning liquid is curbed have been acquired from the experimental data. The present disclosure has been made on the basis of the above findings.

As an aspect of the present disclosure, a technology obtained by further improving the above technology is proposed.

The inkjet recording apparatus according to an aspect of the present disclosure includes a recording head, a wiper member, a cleaning liquid supply device, a cleaning liquid storage device, a cleaning liquid flow path, a driving device, and a control device. The recording head includes an ink ejection surface having an ink ejection port from which ink is ejected. The wiper member moves in a predetermined wiping direction in contact with the ink ejection surface to wipe the ink ejection surface. The cleaning liquid supply device includes a cleaning liquid supply surface including a cleaning liquid supply port configured to supply a cleaning liquid to be used for the wiper member to wipe the ink ejection surface, the cleaning liquid supply device being provided upstream of the ink ejection surface in the wiping direction. The cleaning liquid storage device stores the cleaning liquid. The cleaning liquid flow path is a path for guiding the cleaning liquid from the cleaning liquid storage device to the cleaning liquid supply device. The driving device imparts power for moving the cleaning liquid in the cleaning liquid flow path and extruding the cleaning liquid from the cleaning liquid supply port. The control device includes a processor and, through the processor executing a control program, functions as a controller. The controller performs control of a cleaning operation for wiping the ink ejection surface with the wiper member using the cleaning liquid. The cleaning liquid flow path includes a vertical tubular member whose one end is connected to the cleaning liquid supply device and, from the one end to an opposite end thereof, extending upwardly of the cleaning liquid supply device, and a horizontal tubular member whose one end is connected to an upper end of the vertical tubular member and, from the one end to an opposite end thereof, extending in a horizontal direction. The controller performs control of an air bubble release operation of the cleaning liquid flow path by extruding the cleaning liquid in at least a part of the cleaning liquid flow path from the cleaning liquid supply port before the control of the cleaning operation.

BRIEF DESCRIPTION OF THE DRAWINGS

FIG. 10 is a diagram illustrating results of experimental data of vertical tube air bubble release.

FIG. 11 is a diagram illustrating results of experimental data for overall system air bubble release.

DETAILED DESCRIPTION

Figure 1:
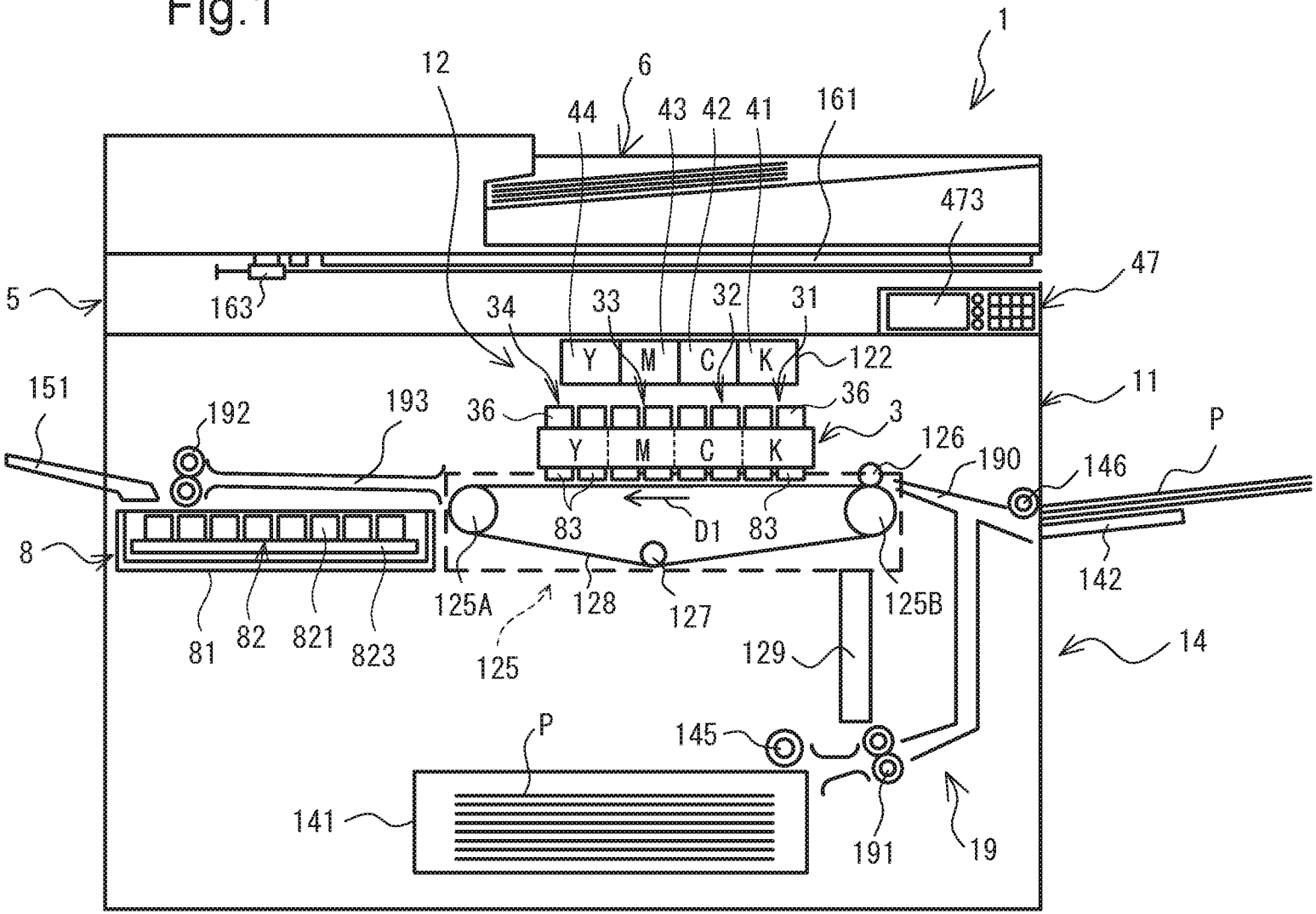
FIG. 1 is a schematic cross-sectional front view illustrating a configuration of an inkjet recording apparatus according to a first embodiment of the present disclosure.
Figure 2:
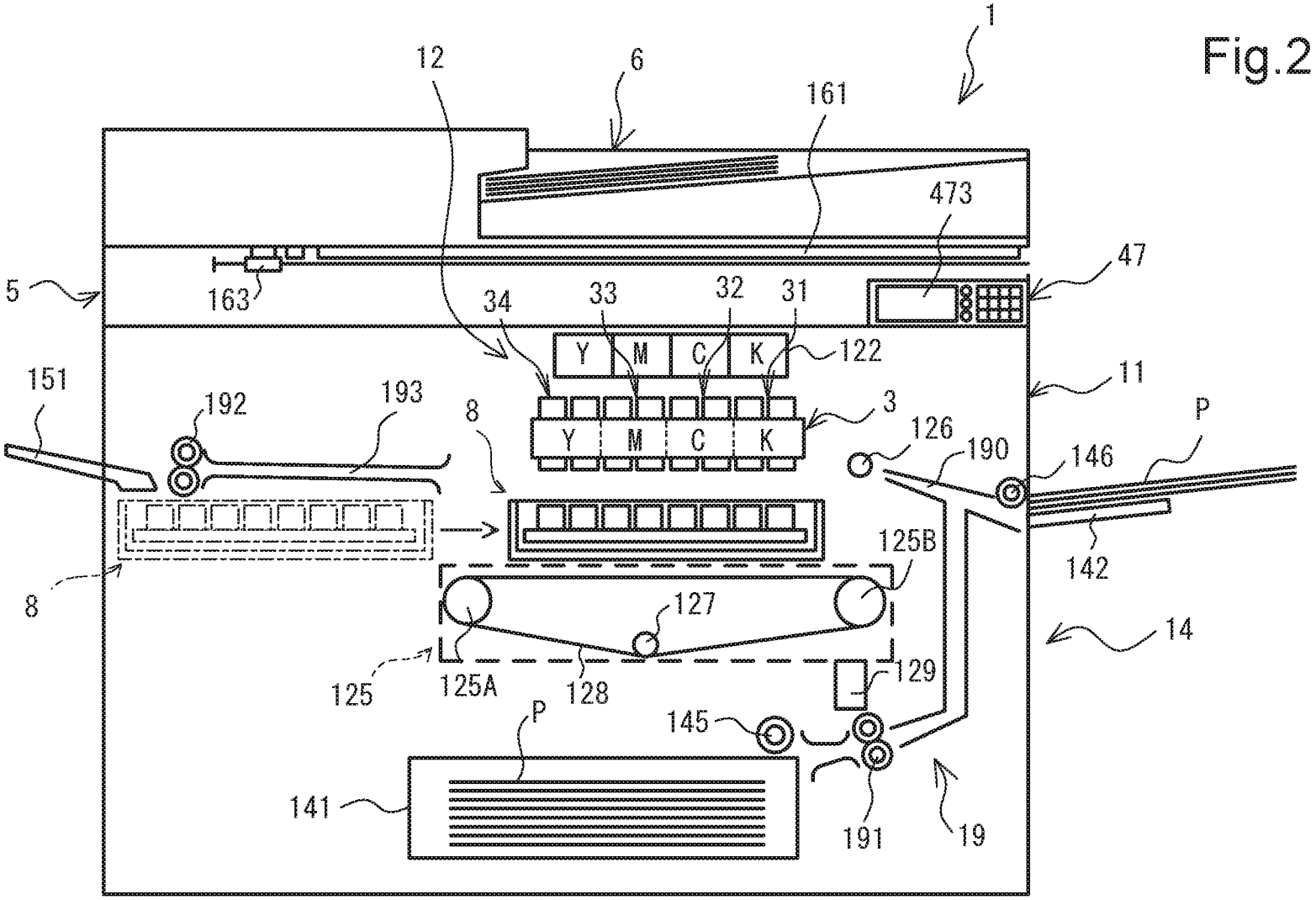
FIG. 2 is a diagram illustrating a state in which a conveyance device has moved to a maintenance position below the conveyance device and a cleaning device has moved to a position immediately below a recording device.

Hereinafter, an inkjet recording apparatus according to an embodiment of the present disclosure will be described with reference to the drawings. FIG. 1 is a cross-sectional front view illustrating a configuration of the inkjet recording apparatus according to a first embodiment of the present disclosure. FIG. 2 is a diagram illustrating a state in which a conveyance device has moved to a maintenance position below the conveyance device, and a cleaning device has moved to a position immediately below the recording device. The inkjet recording apparatus 1 is, for example, a multifunction device having a plurality of functions such as a copy function, a printer function, a scanner function, and a facsimile function, and includes an operation device 47, a document feeding device 6, a document reading device 5, an image recording device 12, a paper feeding device 14, a paper conveyance device 19, a conveyance device 125, and a cleaning device 8 in an apparatus body 11.

The operation device 47 receives an instruction such as an image recording operation execution instruction from an operator for various operations and processes that can be executed by the inkjet recording apparatus 1. The operation device 47 includes a display device 473 that displays operation guidance and the like to the operator. The display device 473 is a touch panel, and the operator can operate the inkjet recording apparatus 1 by touching buttons or keys displayed on a screen.

A case in which a document reading operation is performed by the inkjet recording apparatus 1 will be described. The document reading device 5 optically reads an image of a document fed by the document feeding device 6 or a document placed on a platen glass 161 and generates image data. The image data generated by the document reading device 5 is stored in an image memory (not illustrated) or the like.

The document reading device 5 includes a reading mechanism 163 including a light irradiator, a charge coupled device (CCD) sensor, and the like. The document reading device 5 irradiates the document using the light irradiator having a light source and receives reflected light thereof using the CCD sensor to read an image from the document.

A case in which an image recording operation is performed in the inkjet recording apparatus 1 will be described. The image recording device 12 records an image on paper P fed from the paper feeding device 14 and conveyed by the paper conveyance device 19 on the basis of document image data generated by a document reading operation, document image data stored in an image memory or the like, document image data received from a computer connected to a network, or the like.

The paper feeding device 14 includes a paper feeding cassette 141. A paper feeding roller 145 is provided above the paper feeding cassette 141, and the paper P stored in the paper feeding cassette 141 is fed out toward a conveyance path 190 by the paper feeding roller 145.

Further, the paper feeding device 14 includes a manual feeding tray 142 provided on a wall surface of the apparatus body 11 so that the manual feeding tray 142 can be opened and closed. The paper P set on the manual feeding tray 142 is fed out toward the conveyance path 190 by the paper feeding roller 146.

The paper conveyance device 19 includes the conveyance path 190 that conveys the paper P from the paper feeding device 14 to a discharge tray 151, a conveyance roller pair 191 provided at an appropriate place on the conveyance path 190, and a discharge roller pair 192.

The paper P fed from the paper feeding device 14 is conveyed on the conveyance path 190 by the conveyance roller pair 191. Further, the paper P on which the image has been recorded by the image recording device 12 is discharged to the discharge tray 151 through a discharged paper conveyance path 193 (a part of the conveyance path 190) in a face-up state by the discharge roller pair 192.

Further, the paper conveyance device 19 has an offset mechanism (not illustrated) that moves the discharge roller pair 192 in a direction perpendicular to a paper conveyance direction and shifts the paper P to be discharged to the discharge tray 151 in a paper width direction.

The image recording device 12 records an image based on the document image data on the paper P fed from the paper feeding device 14 and conveyed through the conveyance path 190, and includes the conveyance device 125, an adsorption roller 126, a recording device 3, and an ink tank 122.

The conveyance device 125 includes a driving roller 125A, a driven roller 125B, a tension roller 127, and a conveyance belt 128. The conveyance belt 128 is an endless belt, and is stretched over the driving roller 125A, the driven roller 125B, and the tension roller 127. The driving roller 125A is a roller that is driven by a motor to rotate counterclockwise (not illustrated). When the driving roller 125A is driven to rotate, the conveyance belt 128 travels counterclockwise, and the driven roller 125B and the tension roller 127 passively rotate counterclockwise.

The tension roller 127 is a roller for maintaining a tension state of the conveyance belt 128 in an appropriate state. The adsorption roller 126 is disposed opposite to the driven roller 125B in a state in which the adsorption roller 126 is in contact with the conveyance belt 128, and charges the conveyance belt 128 so that the paper P fed from the paper feeding device 14 is electrostatically adsorbed onto the conveyance belt 128.

The recording device 3 ejects ink droplets of four different colors (black, cyan, magenta, and yellow) toward the paper P conveyed by the paper conveyance device 19, and sequentially records images. The ink tank 122 is filled with ink corresponding to each color.

Specifically, the recording device 3 includes line heads 31, 32, 33, and 34 corresponding to respective colors of black, cyan, magenta, and yellow. Therefore, the inkjet recording apparatus 1 is a line head type inkjet recording apparatus. Further, the recording device 3 includes a head frame 35 (see FIGS. 4A and 4B) that supports the line heads 31 to 34. The head frame 35 is supported by the apparatus body 11.

An elevating mechanism 129 supports the conveyance device 125 from below, and moves the conveyance device 125 up and down with respect to the line heads 31 to 34. That is, the elevating mechanism 129 moves the conveyance device 125 relative to the line heads 31 to 34 so that the conveyance device 125 is separated from the line heads 31 to 34 or approaches the line heads 31 to 34. Specifically, the elevating mechanism 129 moves the conveyance device 125 between a recording position (a position illustrated in FIG. 1) at which printing can be performed by the recording device 3 and a maintenance position (a position illustrated in FIG. 2) separated a predetermined distance downward from the recording position.

Figure 3:
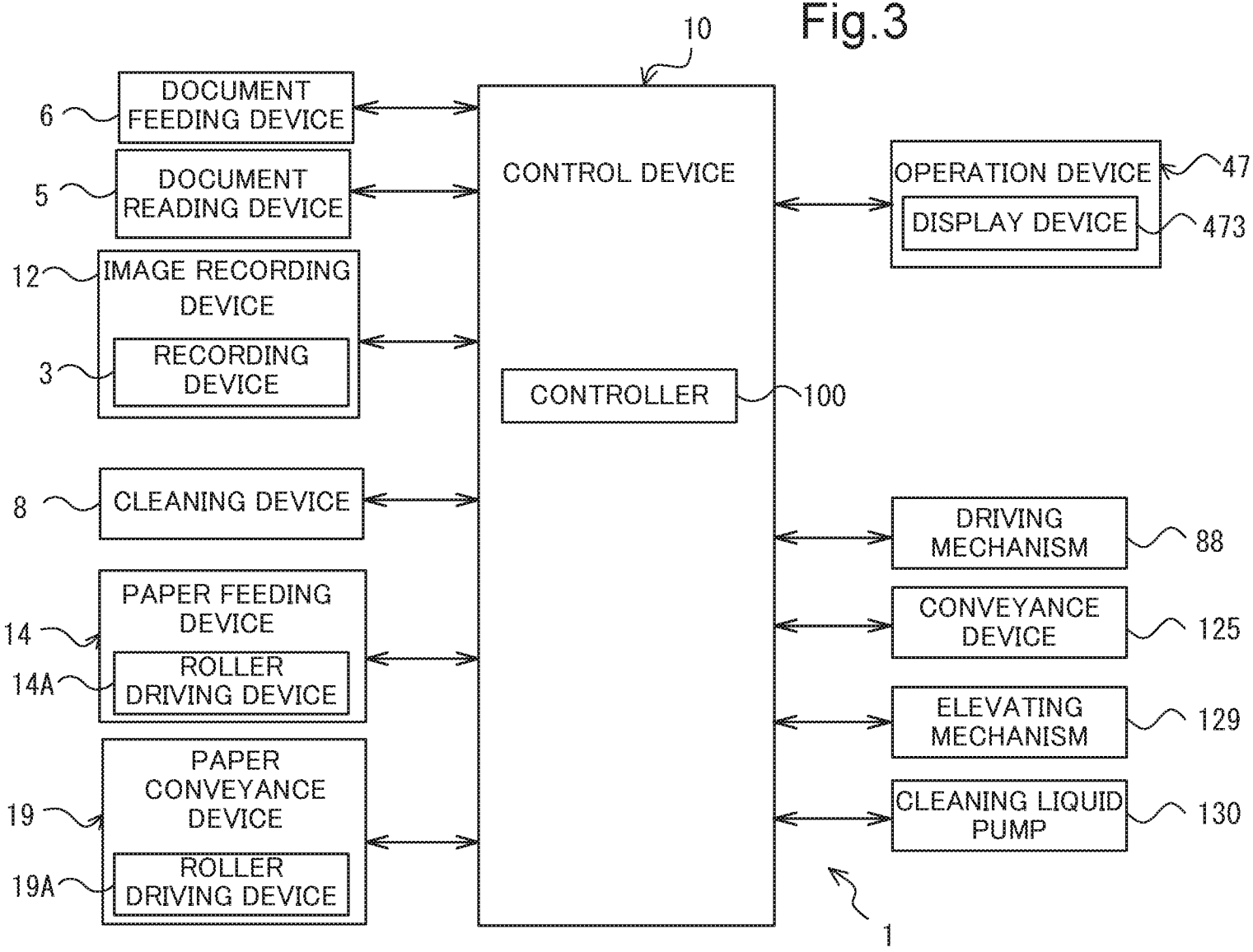
FIG. 3 is a functional block diagram schematically illustrating a main internal configuration of the inkjet recording apparatus according to the first embodiment.

FIG. 3 is a functional block diagram schematically illustrating a main internal configuration of the inkjet recording apparatus according to the first embodiment. The inkjet recording apparatus 1 includes a control device 10, the document feeding device 6, the document reading device 5, the image recording device 12, the paper feeding device 14, the paper conveyance device 19, the operation device 47, a driving mechanism 88, the conveyance device 125, the elevating mechanism 129, a cleaning liquid pump 130, and the cleaning device 8. The same components as those of the inkjet recording apparatus 1 illustrated in FIG. 1 are denoted by the same reference numerals, and detailed description thereof will be omitted.

The paper feeding device 14 and the paper conveyance device 19 include respective roller driving devices 14A and 19A. The roller driving devices 14A and 19A include a motor, a gear, a driver, and the like, and the roller driving device 14A functions as a driving source that imparts a rotational driving force to the paper feeding rollers 145 and 146. The roller driving device 19A functions as a driving source that imparts a rotational driving force to the driving rollers of the conveyance roller pair 191 and the discharge roller pair 192.

The control device 10 includes a processor, a random access memory (RAM), a read only memory (ROM), and a dedicated hardware circuit. The processor is, for example, a central processing unit (CPU), an application specific integrated circuit (ASIC), or a micro processing unit (MPU). The control device 10 includes a controller 100.

The control device 10 functions as the controller 100 through the processor operating according to a control program stored in a built-in nonvolatile memory or the like. However, the controller 100 or the like can be configured using a hardware circuit without depending on an operation of the control device 10 according to the control program. Hereinafter, the same applies to each embodiment unless otherwise specified.

The controller 100 controls an overall operation of the inkjet recording apparatus 1. The controller 100 is connected to the document feeding device 6, the document reading device 5, the image recording device 12, the paper feeding device 14, the paper conveyance device 19, the cleaning device 8, the operation device 47, the driving mechanism 88, the conveyance device 125, the elevating mechanism 129, and the cleaning liquid pump 130, and controls driving of these devices.

The controller 100 performs control of the cleaning operation in which the wiper member 821 wipes the ink ejection surface 361 using the cleaning liquid 831 as will be described below, and control of the air bubble release operation that is executed before the control of the cleaning operation.

Figure 4A:
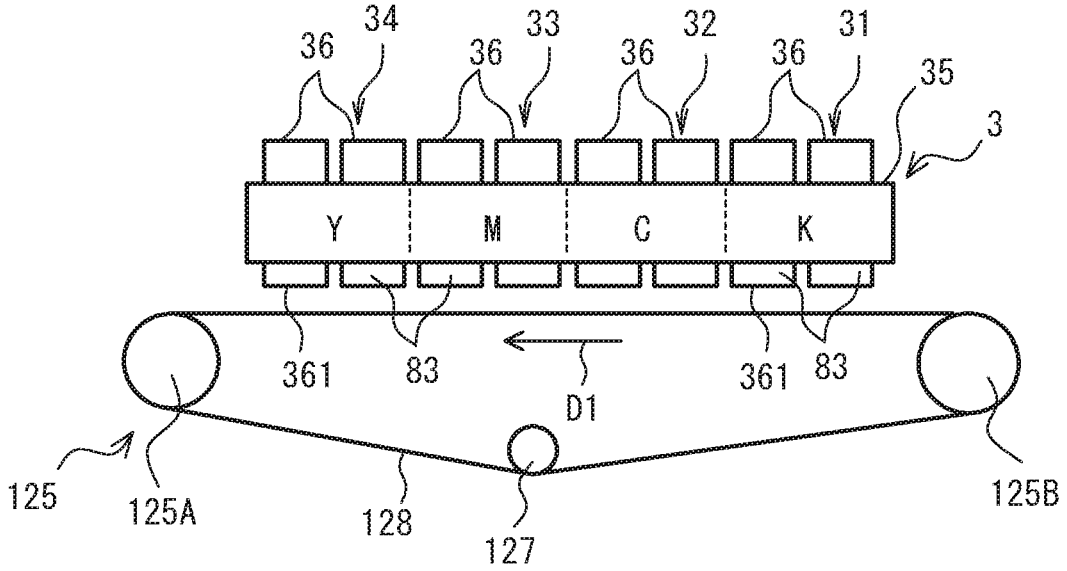
FIG. 4A is a diagram illustrating a recording device and the conveyance device.
Figure 4B:
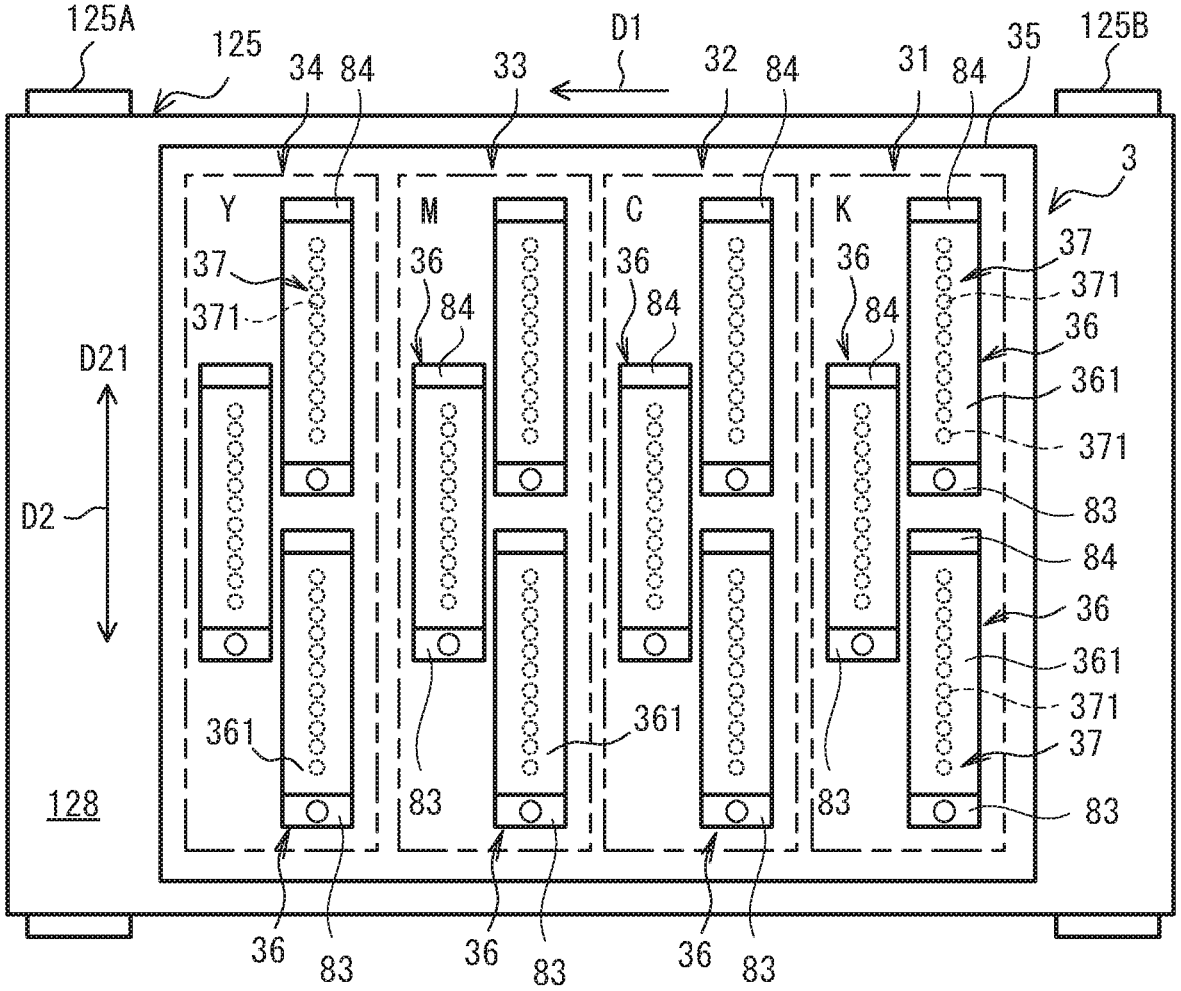
FIG. 4B is a view of the conveyance device and the recording device from above.

Here, a configuration of the recording device 3 will be described in detail with reference to the drawings. FIG. 4A is a diagram illustrating the recording device and the conveyance device. FIG. 4B is a diagram of the conveyance device and the recording device from above.

The conveyance device 125 is disposed below the line heads 31 to 34, as illustrated in FIG. 4A. The conveyance device 125 conveys the paper P while causing the paper P to face the ink ejection surface 361. A gap between the conveyance belt 128 and the ink ejection surface 361 is adjusted so that a gap between a surface of the paper P and the ink ejection surface 361 at the time of image recording is, for example, 1 mm.

The recording device 3 includes line heads 31 to 34 as illustrated in FIG. 4B. The line heads 31 to 34 are long in a width direction D2 (a width direction of the paper P) perpendicular to a conveyance direction D1 of the paper P. A width of the line heads 31 to 34 has a length corresponding to a width of the paper P with a maximum width to be conveyed. The line heads 31 to 34 are respectively fixed to the head frame 35 at predetermined intervals in the conveyance direction D1 of the paper P. Each of the line heads 31 to 34 has a plurality of (for example, three) recording heads 36. Therefore, the recording device 3 includes the twelve recording heads 36.

Figure 5A:
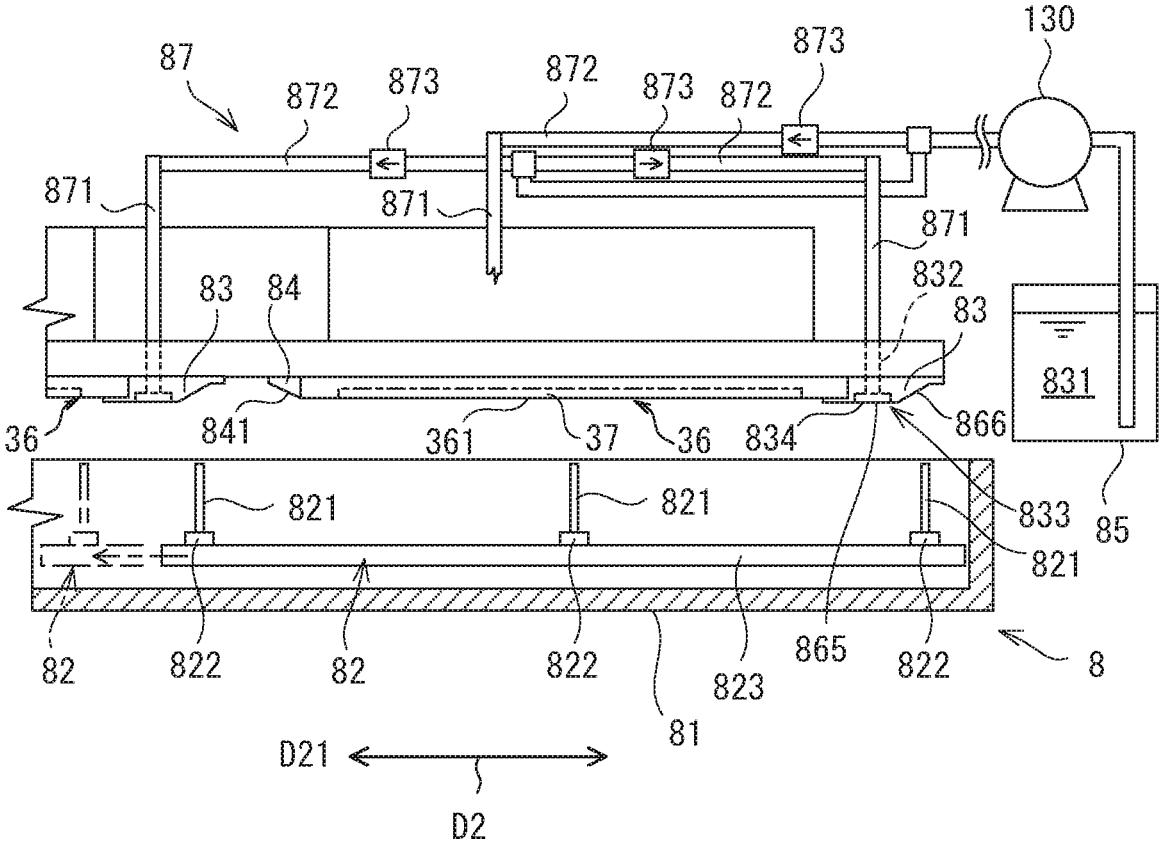
FIG. 5A is a partially cutaway side view illustrating a state in which an ink tray and a wiper device of the cleaning device are disposed below the recording device.
Figure 5B:
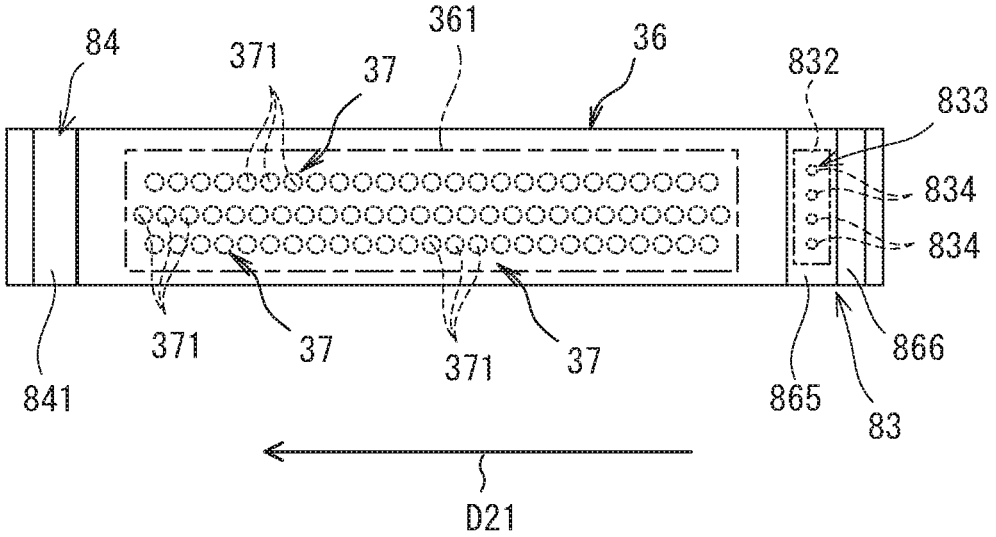
FIG. 5B is a view of an ink ejection surface of a recording head.

The recording head 36 includes a plurality of ink nozzles 37 having ink ejection ports 371 from which ink is ejected. Although in FIG. 4B the plurality of ink nozzles 37 are simply shown in a manner arranged in one row, the ink nozzles 37 are arranged in three rows in a staggered manner as illustrated in FIG. 5B to be described below. A lower surface of the recording head 36 is the ink ejection surface 361 provided with the ink ejection port 371. In the embodiment, the line head 31 includes the three recording heads 36 disposed in a staggered manner in the width direction D2. Further, each of the other line heads 32 to 34 includes the three recording heads 36 disposed in a staggered manner in the width direction D2, similar to the line head 31.

The recording device 3 records an image on the paper P by the ink being ejected from each ink nozzle 37 of each recording head 36 onto the paper P conveyed by the conveyance device 125. As a scheme for ejecting the ink from the line heads 31 to 34, for example, a piezo scheme for ejecting ink using a piezo element, a thermal scheme for generating air bubbles through heating and ejecting ink, and the like are adopted.

The ink tank 122 includes ink tanks 41, 42, 43, and 44 in which inks corresponding to respective colors of black, cyan, magenta, and yellow are stored, as illustrated in FIG. 1. The ink tanks 41 to 44 are connected to the respective line heads 31 to 34 for the same color by ink tubes (not illustrated). The line heads 31 to 34 are supplied with the inks from the respective ink tanks 41 to 44. Here, as the ink, for example, ink containing a color material corresponding to each color in a solvent and water may be used.

The cleaning device 8 is a device that performs an air bubble release operation to be described below and a subsequent cleaning operation (including a purging operation) to restore functions of recording heads 36 of the respective line heads 31 to 34 when the conveyance device 125 is at the maintenance position as illustrated in FIG. 2. The cleaning device 8 includes an ink tray 81 and a wiper device 82, as illustrated in FIGS. 1 and 5A. FIG. 5A is a partially cutaway side view illustrating a state in which the ink tray and the wiper device of the cleaning device are disposed below the recording device. FIG. 5B is a view of the ink ejection surface of the recording head.

The ink tray 81 receives the ink that is discharged from the ink nozzles 37 of each recording head 36. The ink tray 81 is supported to be movable in a horizontal direction (a left and right direction in FIG. 1) by a first moving mechanism (not illustrated). The first moving mechanism is, for example, a driving mechanism 88 that moves the ink tray 81 in the horizontal direction using, for example, a rack-pinion mechanism that converts a rotational motion of a gear connected to a rotating shaft of a motor to a linear motion. The ink tray 81 is disposed at a retracting position (see a position indicated by an alternate long and short dash line in FIG. 2) at which the ink tray 81 is retracted downstream of the recording device 3 in the conveyance direction D1 in a normal state (at the time of printing).

When an instruction for performing the cleaning operation is input, the ink tray 81 is moved to a space created at a place opposite to the line heads 31 to 34 by the first moving mechanism as the conveyance device 125 is moved to the maintenance position by the elevating mechanism 129 (see a position indicated by a solid line in FIG. 2). Further, the ink tray 81 is supported to be movable up and down in a vertical direction (an up and down direction in FIG. 1). When the ink tray 81 is moved to the place opposite to the line heads 31 to 34, the conveyance device 125 is moved up a predetermined distance from the maintenance position by the elevating mechanism 129, such that the ink tray 81 is moved upward.

The wiper device 82 has a configuration in which a plurality of wiper members 821 for cleaning, for example, ink adhered to each ink ejection surface 361 are supported by a pair of side frames 823 via a plurality of stays 822. Further, the wiper device 82 is movable in the width direction D2. In particular, the plurality of wiper members 821 can move in a wiping direction D21 from a cleaning liquid supply device 83 in contact with the ink ejection surface 361 (see FIG. 9 to be described below).

The plurality of wiper members 821 move in the wiping direction D21 and clean the ink ejection surface 361 with the cleaning liquid 831 (see FIG. 8) that is supplied from the cleaning liquid supply device 83.

Here, the plurality of wiper members 821 are formed of, for example, an elastomer in a plate shape having a thickness of 1 mm to 2 mm, and have elasticity. Examples of the elastomer include urethane rubber, ethylene propylene diene rubber (EPDM), nitrile rubber (NBR), styrene rubber (SBR), chloroprene rubber, silicone rubber, and fluoro rubber.

The plurality of stays 822 extend in the conveyance direction D1 and are connected to the pair of side frames 823. In the embodiment, the number of the plurality of stays 822 is three. Four wiper members 821 are fixed to each stay 822. That is, the number of the plurality of wiper members 821 is 12 in correspondence with the number of recording heads 36.

The pair of side frames 823 can reciprocate in the width direction D2 due to a second moving mechanism (not illustrated). The second moving mechanism is the driving mechanism 88 such as the rack-pinion mechanism. For example, by imparting a rotational force to the side frame 823 functioning as a rack via a pinion gear (not illustrated), the side frame 823 reciprocates in the width direction D2. Thereby, the entire wiper device 82 including the plurality of wiper members 821 reciprocates in the width direction D2.

In the recording head 36, the cleaning liquid supply device 83 is provided upstream of the ink ejection surface 361 in the wiping direction D21, as illustrated in FIGS. 5A and 5B. The cleaning liquid supply device 83 includes a cleaning liquid supply surface 865 having a cleaning liquid supply port 834 that supplies the cleaning liquid 831 to be used for the wiper member 821 to wipe the ink ejection surface 361, and is provided upstream of the ink ejection surface 361 in the wiping direction D21.

The cleaning liquid supply device 83 includes an inclined surface 866 that is located upstream in the wiping direction D21 continuously from the cleaning liquid supply surface 865 and is inclined upward with respect to the cleaning liquid supply surface 865 upstream in the wiping direction D21.

The recording device 3 includes a plurality of (12) cleaning liquid supply devices 83 because the recording device 3 includes the twelve recording heads 36, as illustrated in FIG. 4B. The plurality (12) of cleaning liquid supply devices 83 supply the cleaning liquid 831 for cleaning the ink ejection surface 361. The cleaning liquid supply device 83 supplies the cleaning liquid 831 stored in a storage space 832 via the cleaning liquid nozzle 833 communicating with the storage space 832 when the wiper member 821 cleans the ink ejection surface 361.

Figure 8A:
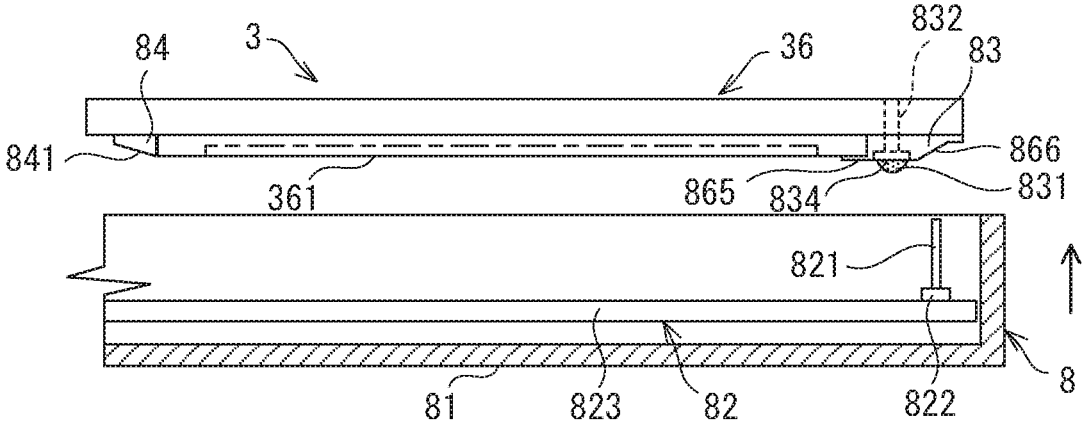
FIGS. 8A to 8E are partially cutaway side views each illustrating an air bubble release operation that is performed before a cleaning operation.

As illustrated in FIG. 8A to be described below, the cleaning liquid 831 is supplied in a state in which the cleaning liquid 831 has projected in a hemispherical shape from the cleaning liquid supply port 834 provided in the cleaning liquid nozzle 833 when the ink ejection surface 361 is cleaned. On the other hand, the cleaning liquid 831 forms a concave meniscus inside the cleaning liquid nozzle 833 at the time other than the time of cleaning of the ink ejection surface 361. Here, the concave meniscus can be formed by adjusting an inner diameter of the cleaning liquid nozzle 833, a negative pressure that the storage space 832 acts inside the cleaning liquid nozzle 833, and the like.

Further, the recording head 36 includes a scattering prevention member 84 provided downstream side of the ink ejection surface 361 in the wiping direction D21, as illustrated in FIGS. 5A and 5B. The scattering prevention member 84 includes an inclined surface 841 with which the wiper member 821 comes into contact after the wiper member 821 wipes the ink ejection surface 361. This inclined surface 841 is located downstream in the wiping direction D21 continuously to the ink ejection surface 361, and inclined upward with respect to the ink ejection surface 361 downstream in the wiping direction D21. Therefore, deflection of the wiper member 821 gradually decreases and finally the wiper member 821 is gently separated from the inclined surface 841 as the wiper member 821 moves in the wiping direction D21 while abutting on the inclined surface 841 of the scattering prevention member 84. Therefore, the scattering of the liquid can be reduced as compared with a configuration without the scattering prevention member 84. Further, the scattering prevention member 84 is formed of, for example, a polyacetal resin (POM). The ink ejection surface 361 of the recording head 36 is subjected to, for example, a fluorine-based water-repellent film process. Therefore, water repellency of the scattering prevention member 84 is lower than that of the ink ejection surface 361. Therefore, even when the cleaning liquid remains on the scattering prevention member 84, contact of the droplet with the paper can be reduced due to a low droplet height.

A cleaning liquid storage device 85 stores the cleaning liquid 831, as illustrated in FIG. 5A. Here, for example, a liquid obtained by removing a coloring material from ink can be used as the cleaning liquid 831. That is, a liquid containing a solvent and water as main components can be used as the cleaning liquid 831. Further, a surfactant, a preservative, and a fungicide are added to the cleaning liquid 831, as necessary.

Figure 6:
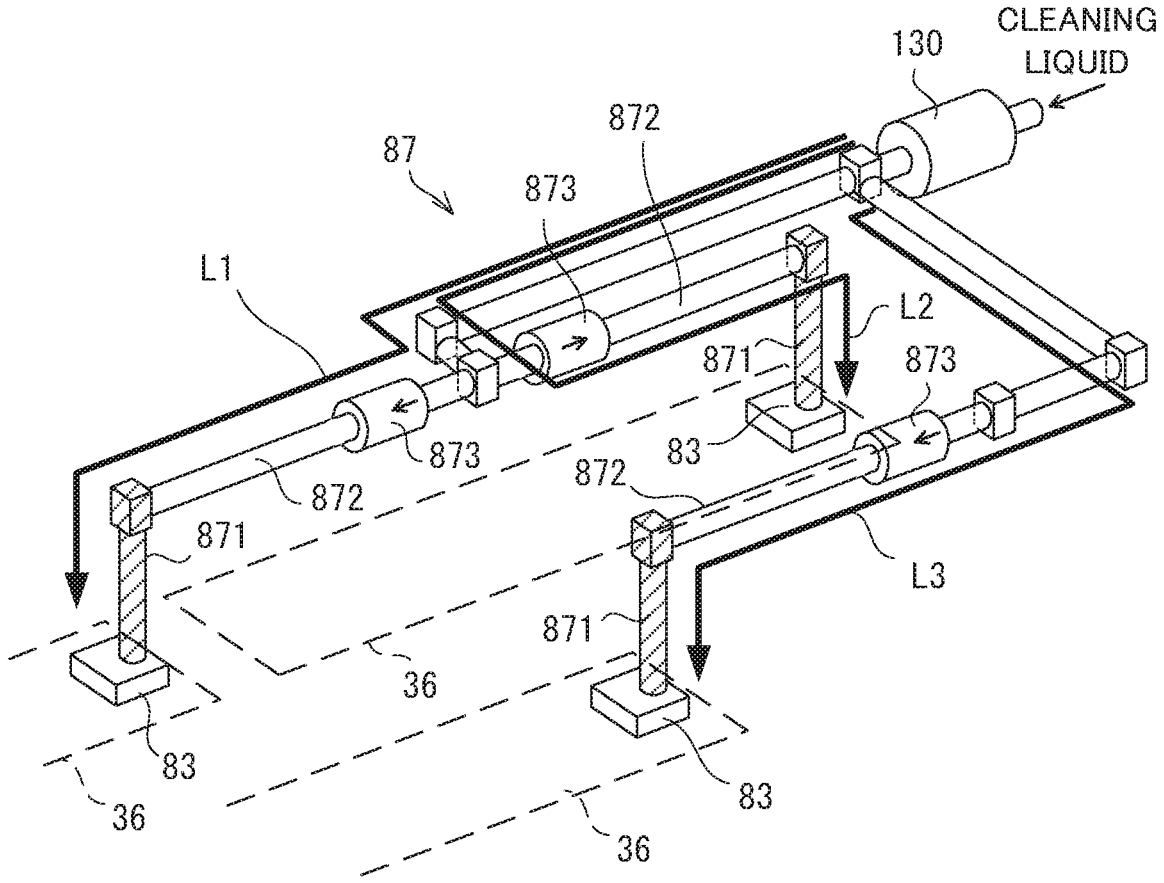
FIG. 6 is a diagram schematically illustrating a cleaning liquid flow path for supplying a cleaning liquid to a line head.

FIG. 6 is a diagram schematically illustrating a cleaning liquid flow path for supplying a cleaning liquid to a line head. In FIG. 6, a cleaning liquid flow path 87 for the line head 31 is illustrated. The cleaning liquid flow path 87 is a pipe for guiding the cleaning liquid 831 from the cleaning liquid storage device 85 to the cleaning liquid supply device 83 of a plurality (for example, three) of recording heads 36. The cleaning liquid flow path 87 is provided for each of the line heads 31 to 34. That is, the cleaning liquid flow path 87 is one path for each color. The cleaning liquid flow path 87 of the other line heads 32 to 34 are the same as that of the line head 31.

The cleaning liquid flow path 87 includes vertical tubular members 871 and horizontal tubular members 872. The vertical tubular member 871 is a vertical pipe having one end connected to the cleaning liquid supply device 83 and, from the one end to the other end, extending upwardly of the cleaning liquid supply device 83, and is hatched in FIG. 6. The horizontal tubular member 872 is a horizontal pipe having one end connected to an upper end of the vertical tubular member 871 and, from the one end to the other end, extending in a horizontal direction. A capacity of the horizontal tubular member 872 is, for example, five times a total capacity of the cleaning liquid supply device 83 and the vertical tubular member 871.

Further, the horizontal tubular member 872 includes a check valve 873 that guides the cleaning liquid 831 in a direction of the vertical tubular member 871. Thereby, it is possible to prevent the cleaning liquid 831 from returning to the cleaning liquid storage device 85, and stably perform extrusion control for the cleaning liquid 831.

The cleaning liquid pump 130 is a cleaning liquid pump that imparts power for moving the cleaning liquid 831 in the cleaning liquid flow path 87 and extruding the cleaning liquid 831 from the cleaning liquid supply port 834. The cleaning liquid flow path 87 is connected to an output side of the cleaning liquid pump 130, and an input side flow path connected to the cleaning liquid storage device 85 is connected to an input side of the cleaning liquid pump 130. One cleaning liquid pump 130 is provided for each cleaning liquid flow path 87, that is, for each color. The cleaning liquid pump 130 is an example of a driving device in What is claimed is.

Further, respective flow path lengths L1, L2, and L3 from the cleaning liquid pump 130 to the respective cleaning liquid supply devices 83 of the three recording heads 36 for the same color are the same, as illustrated in FIG. 6. Thereby, in the cleaning liquid flow path 87 including the vertical tubular member 871 and the horizontal tubular member 872, an extrusion amount in each cleaning liquid supply device 83 can be made equal.

Figure 7A:
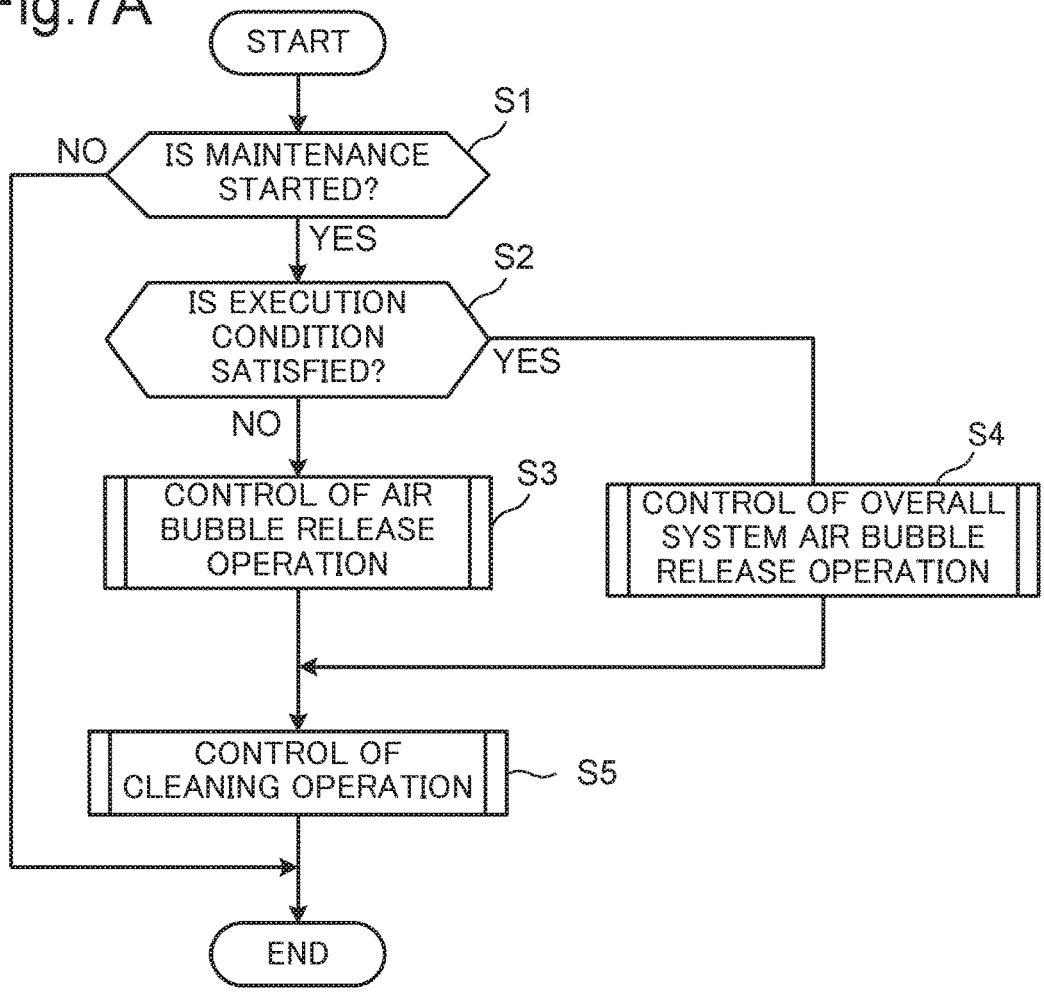
FIG. 7A is a flowchart illustrating an example of a process that is performed by the inkjet recording apparatus according to the first embodiment.

Next, an example of a process that is performed by the control device 10 of the inkjet recording apparatus 1 according to the first embodiment will be described with reference to the drawings. FIG. 7A is a flowchart illustrating an example of a process that is performed by the inkjet recording apparatus according to the first embodiment.

As illustrated in FIG. 7A, the controller 100 determines whether or not maintenance has started (S1). Specifically, for example, when a predetermined time before start of printing has elapsed since the power-ON of the inkjet recording apparatus 1, the controller 100 determines that maintenance starts (YES in S1), moves the conveyance device 125 to the maintenance position, and moves the cleaning device 8 to a position immediately below the recording device 3, as illustrated in FIG. 2. A maintenance start timing is not limited to the above case and may be various timings such as when a power-OFF operation of the inkjet recording apparatus 1 is received, when a predetermined operation time of the inkjet recording apparatus 1 has elapsed, and when the number of prints of the inkjet recording apparatus 1 exceeds a predetermined total number of prints.

When the controller 100 determines that the maintenance has started (YES in S1), the controller 100 determines whether or not a predetermined execution condition (that is, a condition for determining whether or not to control of the overall system air bubble release operation is performed) is satisfied (S2). When the predetermined execution condition is satisfied before the control of the cleaning operation, the controller 100 performs control of the overall system air bubble release operation. The predetermined execution condition is, for example, a condition that the number of executions of the control of the cleaning operation reaches predetermined multiple times (for example, 15 times). Specifically, when the number of cleaning executions has not reached the predetermined multiple times (for example, 15 times) (NO in S2), the controller 100 performs control of the air bubble release operation (which may be hereinafter appropriately referred to as a "vertical tube air bubble release control") different from the overall system air bubble release operation (S3).

The control of the air bubble release operation (vertical tube air bubble release control) in S3 will be described herein. FIGS. 8A to 8E are partially cutaway side views each illustrating an air bubble release operation that is performed before the cleaning operation.

The controller 100 drives the elevating mechanism 129 to move the conveyance device 125 up by a predetermined distance from the maintenance position in a state in which the cleaning device 8 is moved to the position immediately below the recording device 3 (see FIG. 8A), such that the ink tray 81 is disposed at a purge position immediately below the ink ejection surface 361 (see FIG. 8B). Thereby, the plurality of wiper members 821 of the cleaning device 8 are located immediately below the inclined surface 866 of the cleaning liquid supply device 83 adjacent to the respective corresponding recording heads 36 (see FIG. 8B). In this case, tips of the plurality of wiper members 821 are located above a plane including the cleaning liquid supply surface 865. A position at which the tip of the wiper member 821 is disposed in a region immediately below the inclined surface 866 and a region above the plane including the cleaning liquid supply surface 865 is a movement start position of the wiper member 821 in the air bubble release operation.

The controller 100 controls the air bubble release operation (vertical tube air bubble release control) including the following (i) to (iii) (S3).

Figure 8B:
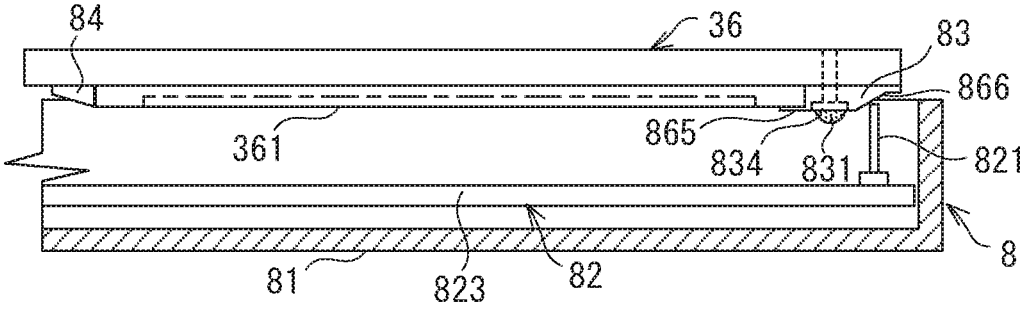

The controller 100 (*i*) extrudes the cleaning liquid 831 of an amount of 0.5 times or more and 0.9 times or less the total capacity of the cleaning liquid supply device 83 and the vertical tubular member 871 from the cleaning liquid supply port 834 (see FIG. 8B). It was confirmed from experimental data illustrated in FIG. 10 to be described below that the cleaning liquid 831 of an amount of 0.5 times or more and 0.9 times or less the total capacity is preferable. The cleaning liquid 831 discharged to the ink tray 81 is discharged from a discharge port provided at a bottom of the ink tray 81 to a predetermined waste ink storage device through an ink tube (not illustrated).

Figure 8C:
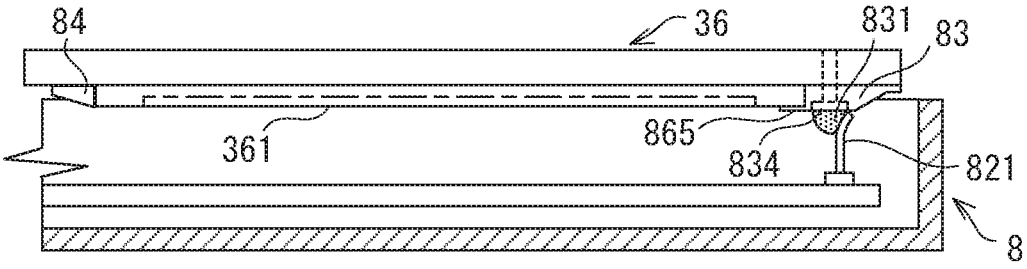
Figure 8D:
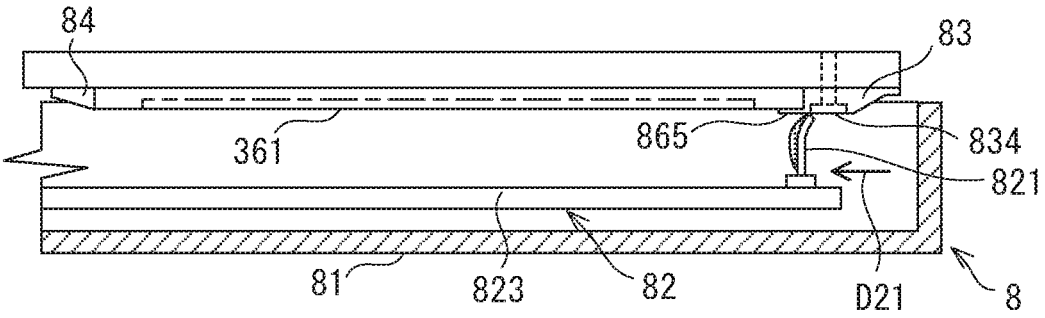

Subsequently, the controller 100 drives the second moving mechanism (not illustrated) to horizontally move the wiper device 82 in the wiping direction D21, thereby (ii) moving the wiper member 821 from the movement start position that is a position upstream of the cleaning liquid supply surface 865 in the wiping direction D21 to a position before the ink ejection surface 361 in the wiping direction D21 (see FIGS. 8C and 8D). That is, the controller 100 causes the wiper member 821 to perform wiping in a range including at least a part of the cleaning liquid supply surface 865 and not including the ink ejection surface 361.

Figure 8E:
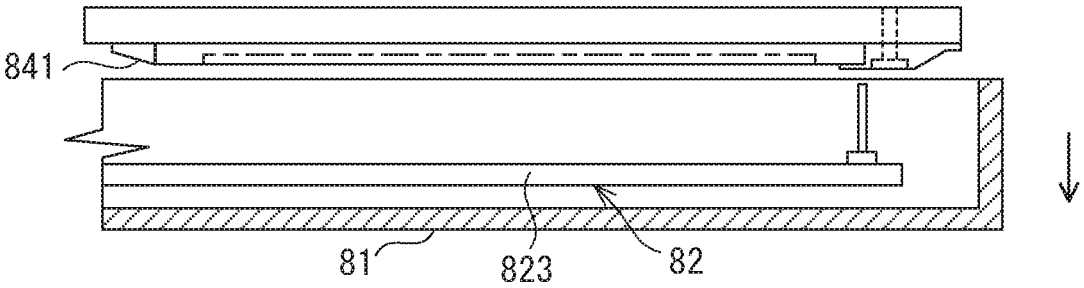

Subsequently, the controller 100 drives the elevating mechanism 129 to move the conveyance device 125 down by a predetermined distance and return the conveyance device 125 to the maintenance position, thereby (iii) performing control for separating the wiper member 821 from the cleaning liquid supply surface 865 as illustrated in FIG. 8E.

On the other hand, when the number of cleaning executions has reached the predetermined multiple times (for example, 15 times) (YES in S2), the controller 100 performs control of the overall system air bubble release operation rather than the vertical tube air bubble release control (S4). The number of cleaning executions is stored in a non-volatile memory included in the control device 10 each time cleaning is performed.

Figure 7B:
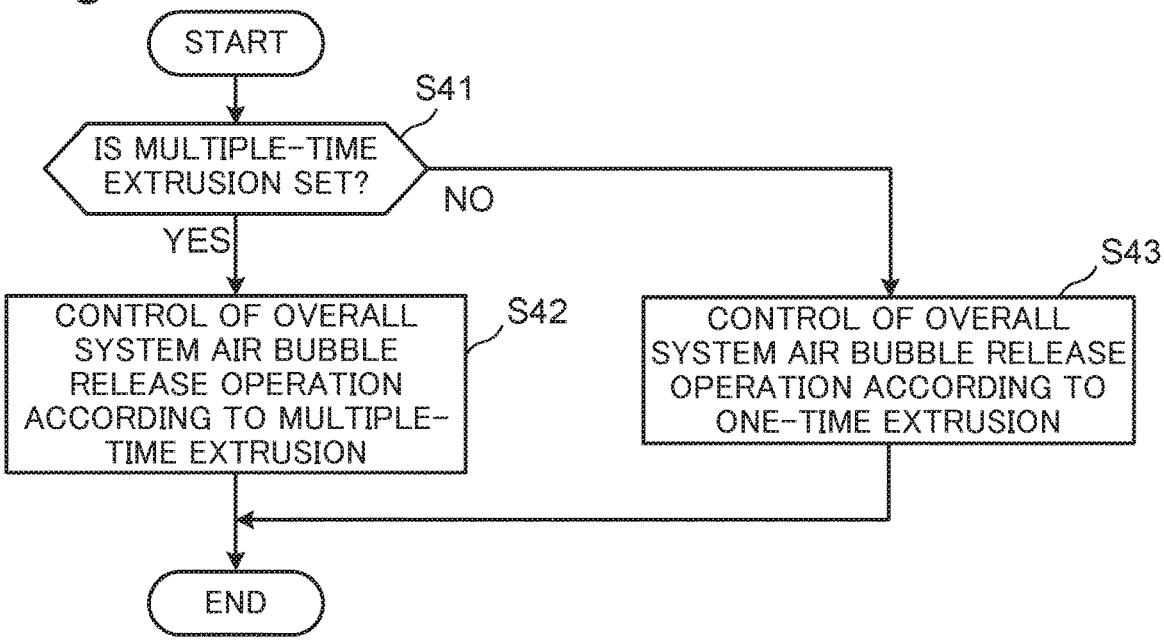
FIG. 7B is a flowchart illustrating an example of an overall system air bubble release process.

When the number of cleaning executions has reached the predetermined multiple times (for example, 15 times) (YES in S2), the controller 100 performs control of the overall system air bubble release operation (S4). FIG. 7B is a flowchart illustrating an example of an overall system air bubble release process.

The controller 100 determines whether an extrusion setting for the cleaning liquid 831 at the time of overall system air bubble release is a multiple-time extrusion setting (S41). Specifically, the extrusion setting for the cleaning liquid 831 is stored in a non-volatile memory embedded into the control device 10 in advance. The controller 100 determines that the extrusion setting for the cleaning liquid 831 is a one-time extrusion setting when the extrusion setting for the cleaning liquid 831 stored in the non-volatile memory in advance is one time, and determines that the extrusion setting for the cleaning liquid 831 is the multiple-time extrusion setting when the extrusion setting for the cleaning liquid 831 is multiple times.

When the controller 100 has determined that the extrusion setting for the cleaning liquid 831 at the time of overall system air bubble release is a multiple-time extrusion setting (YES in S41), the controller 100 performs control of the overall system air bubble release operation according to the multiple-time extrusion (S42).

The controller 100 performs control of the overall system air bubble release operation including (iA), (ii), and (iii) below (S42). The control of the overall system air bubble release operation is different from the vertical tube air bubble release control described above in that the amount of extrusion of the cleaning liquid 831 is larger, and an operation of the wiper device 82 is the same as in the vertical tube air bubble release control described above, as illustrated in FIGS. 8A to 8E.

(iA) When the cleaning liquid 831 is extruded from the cleaning liquid supply port 834 multiple times, the controller 100 extrudes the cleaning liquid 831 of an amount of 0.5 times or more and 1 times or less the capacity of the horizontal tubular member 872 from the cleaning liquid supply port 834 multiple times so that the total amount of the multiple-time extrusion becomes 1.5 times or more the capacity of the horizontal tubular member 872 (see FIG. 8B). It was confirmed from experimental data illustrated in FIG. 11 to be described below that content of the extrusion is suitable.

Subsequently, the controller 100 (ii) moves the wiper member 821 from the movement start position that is a position upstream of the cleaning liquid supply surface 865 in the wiping direction D21 to a position before the ink ejection surface 361 in the wiping direction D21 (see FIGS. 8C and 8D). Subsequently, the controller 100 performs (iii) control for separating the wiper member 821 from the cleaning liquid supply surface 865 as illustrated in FIG. 8E. Since (ii) and (iii) are the same as (ii) and (iii) in the vertical tube air bubble release control described above, detailed description thereof will be omitted herein.

On the other hand, in S41, when the controller 100 has determined that the extrusion setting for the cleaning liquid 831 at the time of overall system air bubble release is an one-time extrusion setting (NO in S41), the controller 100 performs the control of the overall system air bubble release operation according to the one-time extrusion (S43). It was confirmed from the experimental data illustrated in FIG. 11 to be described below that content of the extrusion is suitable.

The controller 100 performs the control of the overall system air bubble release operation including (iB), (ii), and (iii) below (S43). (iB) When the cleaning liquid 831 is extruded from the cleaning liquid supply port 834 once, the controller 100 extrudes the cleaning liquid 831 of an amount of 1.5 times or more the capacity of the horizontal tubular member 872 from the cleaning liquid supply port 834 once and performs (ii) and (iii) (S43).

The controller 100 performs control of the cleaning operation after performing the vertical tube air bubble release control process (S3) or the overall system air bubble release control process (S4) as illustrated in FIG. 7A (S5). FIGS. 9A to 9E are partially cutaway side views each illustrating the cleaning operation.

Figure 9A:
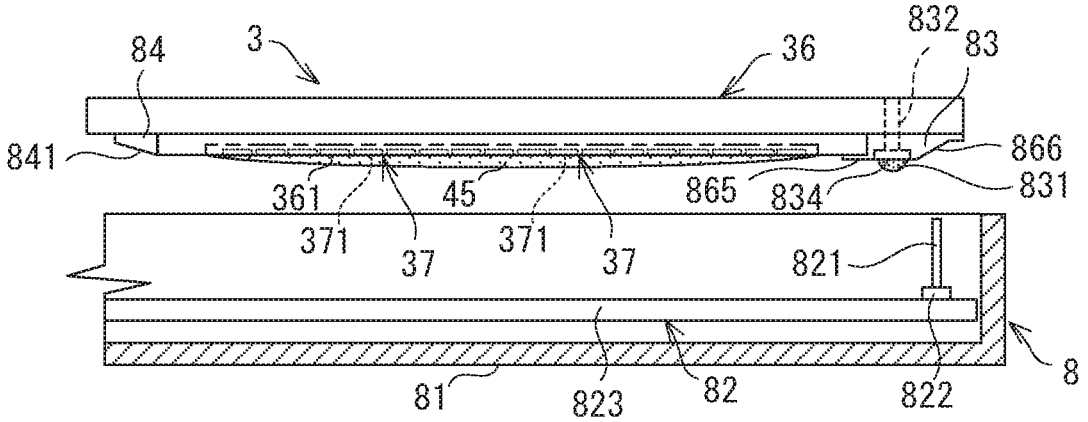
FIGS. 9A to 9E are partially cutaway side views each illustrating the cleaning operation.

The controller 100 supplies purge ink 45 to the recording head 36, and discharges the purge ink 45 from the ink ejection port 371 of the ink nozzle 37, as illustrated in FIG. 9A. Thereby, thickened ink, foreign matters, air bubbles, and the like in the ink nozzle 37 are discharged to the ink tray 81 together with the purge ink 45 supplied to the ink nozzle 37. Clogging of the ink nozzle 37 is resolved by such a purge operation. The ink discharged to the ink tray 81, or the like is discharged from a discharge port provided at a bottom of the ink tray 81 to a predetermined waste ink storage device through an ink tube (not illustrated).

When the purging operation has ended, the cleaning device 8 performs the cleaning operation. The cleaning operation is an operation for wiping, for example, the purge ink 45 adhered to the ink ejection surface 361 using the wiper member 821. In the cleaning operation, the controller 100 extrudes a predetermined amount (for example, 1.5 mL) of cleaning liquid 831, such that the cleaning liquid 831 is projected and supplied in a hemispherical shape from the cleaning liquid supply port 834 of the cleaning liquid supply device 83 (FIG. 9A). The predetermined amount (for example, 1.5 mL) is a total extrusion amount of the respective line heads 31 to 34, that is, a total extrusion amount for four colors. Further, the supply of the cleaning liquid 831 may be performed simultaneously with the discharge of the purge ink 45 or before or after the discharge of the purge ink 45.

Figure 9B:
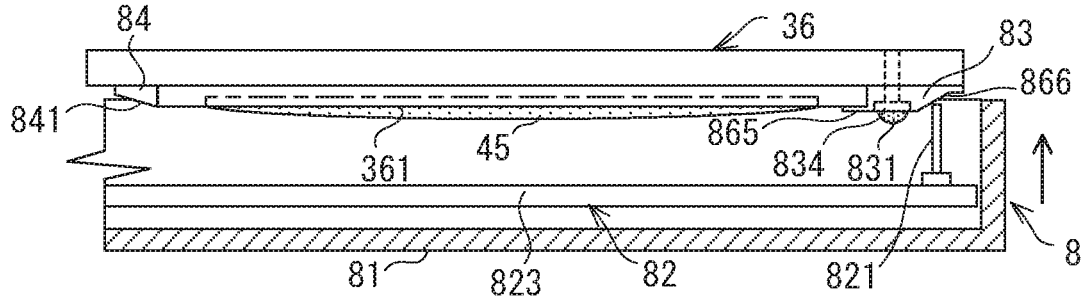
Figure 9C:
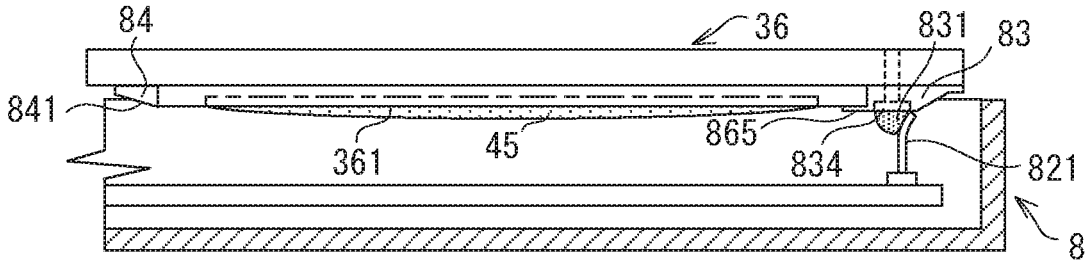
Figure 9D:
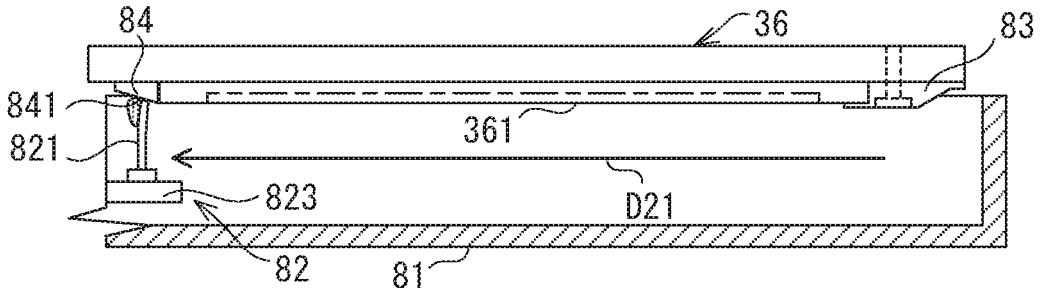

When the supply of the cleaning liquid 831 has ended, the controller 100 drives the second moving mechanism (not illustrated) to move the wiper device 82 horizontally in the wiping direction D21, as illustrated in FIGS. 9B to 9D. Specifically, the controller 100 positions the wiper member 821 at the movement start position (see FIG. 9B), and moves the wiper member 821 from the movement start position to an end position that is a position at which contact with the scattering prevention member 84 occurs (see FIGS. 9C and 9D). In this case, the wiper member 821 moves in contact with the scattering prevention member 84 via the inclined surface 866, the cleaning liquid supply port 834, and the ink ejection surface 361.

Further, the plurality of wiper members 821 wipe, for example, the purge ink 45 adhered to the ink ejection surface 361 when the wiper members 821 move in contact with the ink ejection surface 361, as illustrated in FIG. 9D. Remaining ink or the like wiped by the plurality of wiper members 821 moves downward along a surface of the wiper member 821 together with the cleaning liquid 831, and falls onto the ink tray 81.

Figure 9E:
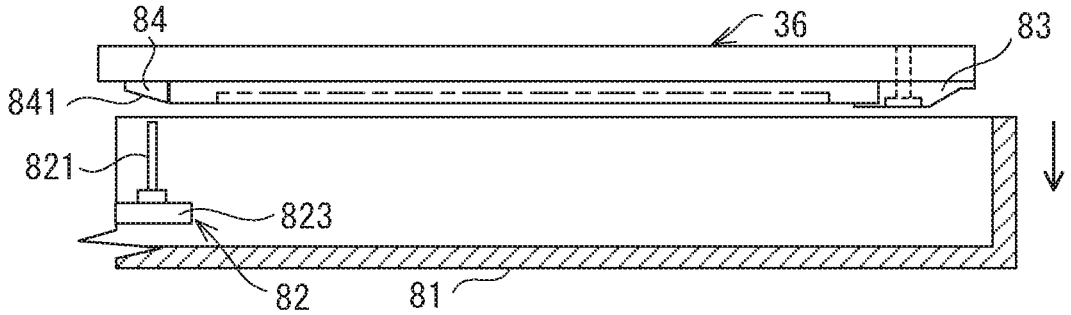

Subsequently, the controller 100 drives the elevating mechanism 129 to move the conveyance device 125 down by a predetermined distance and return the conveyance device 125 to the maintenance position, thereby separating the wiper member 821 from the scattering prevention member 84 as illustrated in FIG. 9E.

Thereafter, the controller 100 drives the elevating mechanism 129 to lower the conveyance device 125 to the maintenance position (see FIG. 2), and drives the first moving mechanism to return the ink tray 81 of the cleaning device 8 to the retracting position (see FIG. 1). Further, the controller 100 drives the elevating mechanism 129 to return the conveyance device 125 to the recording position (the position illustrated in FIG. 1). The controller 100 ends a process illustrated in FIG. 7A.

Here, the experimental data for vertical tube air bubble release will be described with reference to FIG. 10. FIG. 10 is a diagram illustrating a result of experimental data for vertical tube air bubble release. As illustrated in FIG. 6, the line head 31 includes three sets of cleaning liquid supply devices 83 and vertical tubular members 871. That is, there are three sets of cleaning liquid supply devices 83 and vertical tubular members 871 for one color. Therefore, there are 12 sets (=3 sets×4 colors) of cleaning liquid supply devices 83 and vertical tubular members 871 for four colors. The total capacity of the 12 sets of cleaning liquid supply devices 83 and vertical tubular members 871 is, for example, 4 mL.

An experiment was performed in which, after air was introduced into the vicinity of the vertical tubular member 871 and the cleaning liquid supply port 834 in advance, the air bubble release operation of the cleaning liquid supply port 834, that is, the air bubble release operation in which the extrusion amount of cleaning liquid 831 was set to 4.0 mL, 3.6 mL, 2.8 mL, 2.0 mL, and 1.2 mL was performed, and then a cleaning operation was performed. In the experiment, the number N of experiments at each extrusion amount was 10, a circle is marked when there were no bubbles in the scattering prevention member 84 after the cleaning operation of the recording head 36 ended, and a cross is marked when there were bubbles. It was confirmed from the experimental data illustrated in FIG. 10 that the cleaning liquid 831 of an amount of 0.5 times or more and 0.9 times or less (a magnification A in FIG. 10 is 0.5 or more and 0.9 or less) of the total capacity is preferable.

Next, experimental data for overall system air bubble release will be described with reference to FIG. 11. FIG. 11 is a diagram illustrating a result of the experimental data for overall system air bubble release. The line head 31 includes three horizontal tubular members 872, as illustrated in FIG. 6. That is, there are three horizontal tubular members 872 for one color. Therefore, there are 12 (=3×4 colors) horizontal tubular members 872 for four colors. A total capacity of the 12 horizontal tubular members 872 is, for example, 20 mL.

An experiment was performed in which, after air was introduced into the horizontal tubular member 872 in advance, an air bubble release operation of the horizontal tubular member 872, that is, the overall system air bubble release operation in which the cleaning liquid 831 of the extrusion amount of 30 mL was extruded once, the cleaning liquid 831 of 20 mL was extruded once or twice, the cleaning liquid 831 of 14 mL was extruded one to three times, the cleaning liquid 831 of 10 mL was extruded one to three times, and the cleaning liquid 831 of 6 mL was extruded one to six times was performed, and then the cleaning operation was performed. In the experiment, the number N of experiments at each extrusion amount was 10, a circle is marked when there were no bubbles in the scattering prevention member 84 after the cleaning operation of the recording head 36 ended, and a cross is marked when there were bubbles.

It was confirmed from the experimental data illustrated in FIG. 11 that one extrusion at the extrusion amount of cleaning liquid 831 of 30 mL is preferable. That is, it is preferable for the cleaning liquid 831 of an amount (=30 mL) 1.5 times (a magnification B in FIG. 11 is 1.5) or more the capacity (=20 mL) of the horizontal tubular member 872 to be extruded from the cleaning liquid supply port 834 once.

Further, it was confirmed from the experimental data illustrated in FIG. 11 that, when the extrusion was performed multiple times, it is preferable that the cleaning liquid 831 of the extrusion amount of 20 mL was extruded twice, the cleaning liquid 831 of the extrusion amount of 14 mL was extruded at three times, and the cleaning liquid 831 of the extrusion amount of 10 mL was extruded at three times. That is, it is preferable for the cleaning liquid 831 of an amount (=10 mL to 20 mL) of 0.5 times or more and 1 times or less (the magnification B in FIG. 11 is 0.5 or more and 1.0 or less) of the capacity (=20 mL) of the horizontal tubular member 872 to be extruded from the cleaning liquid supply port 834 multiple times so that a total amount of multiple-time extrusions becomes 1.5 times or more the capacity (=20 mL) of the horizontal tubular member 872.

According to the first embodiment, the cleaning liquid flow path 87 includes the vertical tubular member 871 having the one end connected to the cleaning liquid supply device 83 and, from the one end to the other end, extending upwardly of the cleaning liquid supply device 83, and the horizontal tubular member 872 having the one end connected to the upper end of the vertical tubular member 871 and, from the one end to the other end, extending in the horizontal direction. It is possible to stop air bubbles present in the vertical tubular member 871 with the vertical tubular member 871, to stop air bubbles present in the horizontal tubular member 872 with the horizontal tubular member 872, and separate air bubbles with the vertical tubular member 871 and the horizontal tubular member 872 as long as the cleaning liquid 831 is not extruded. Further, the vertical tubular member 871 forms a flow path in a vertical direction, air bubbles present in the vertical tubular member 871 can be roughly divided into a lower end side and an upper end side and collected, and air bubbles are not present in a path portion between the lower end side and the upper end side or it can be difficult for air bubbles to be present in the path portion. Thereby, it is possible to provide a cleaning liquid flow path capable of preferably realizing the air bubble release control while curbing a supply amount of cleaning liquid 831. Further, the controller 100 extrudes the cleaning liquid 831 in at least a part of the cleaning liquid flow path 87 from the cleaning liquid supply port 834 before control of the cleaning operation for wiping the ink ejection surface 361 of the recording head 36, thereby performing the control of the air bubble release operation of the cleaning liquid flow path 87. That is, since the control of the air bubble release operation is performed before the control of the cleaning operation is executed, it is possible to reduce the occurrence of image defects due to paper stains, as compared with a configuration in which the control of the cleaning operation is merely performed.

Incidentally, in the inkjet recording apparatus described in the BACKGROUND, there is a problem that image defects may occur due to unknown paper stains even though the mist adhered to the nozzle surface is removed by a mechanism for wiping the nozzle surface using a wiper with a cleaning liquid.

On the other hand, in the embodiment, it is possible to reduce occurrence of image defects due to paper stains.

Further, as control of the air bubble release operation (vertical tube air bubble release control), the controller 100 (i) extrudes the cleaning liquid 831 of an amount of 0.5 times or more and 0.9 times or less the total capacity of the cleaning liquid supply device 83 and the vertical tubular member 871 from the cleaning liquid supply port 834 as illustrated in FIG. 10. Thereby, the air bubbles present in the cleaning liquid supply device 83 and the air bubbles present on the lower end side of the vertical tubular member 871 can be extruded together with the cleaning liquid 831, and there can be no air bubbles in the cleaning liquid 831 in the cleaning liquid supply port 834. Incidentally, when the cleaning liquid 831 of an amount that is one time the total capacity is extruded from the cleaning liquid supply port 834, air bubbles present on the upper end side of the vertical tubular member 871 reach the cleaning liquid supply port 834, and these air bubbles become bubbles at the cleaning liquid supply port 834. On the other hand, since the cleaning liquid 831 is limited to the cleaning liquid 831 of an amount of 0.9 times or less the total capacity, the air bubbles present on the upper end side of the vertical tubular member 871 can be prevented from reaching the cleaning liquid supply port 834, bubbles caused by the air bubbles present on the upper end side of the vertical tubular member 871 can be prevented from being generated, and there can be no bubbles in the cleaning liquid 831 in the cleaning liquid supply port 834. Since the controller 100 (ii) moves the wiper member 821 in the wiping direction D21 and (iii) separates the wiper member 821 from the cleaning liquid supply surface 865, no bubbles remain on the cleaning liquid supply surface 865. Therefore, the control of the air bubble release operation can be preferably executed. After the air bubble release operation, the control of the cleaning operation is performed. That is, since the control of the cleaning operation for wiping the ink ejection surface 361 using the wiper member 821 using the bubble-free cleaning liquid 831 is performed, no bubbles remain on the ink ejection surface 361 of the recording head 36. Thereby, it is possible to reduce the occurrence of image defects due to paper stains.

Further, the controller 100 performs, as the control of the cleaning operation, control for extruding the purge ink 45 from the ink ejection port 371 of the recording head 36, extruding the cleaning liquid 831 from the cleaning liquid supply port 834, moving the wiper member 821 from the movement start position to the end position that is a position at which contact with the scattering prevention member 84 occurs via the ink ejection surface 361 in the wiping direction D21, and separating the wiper member 821 from the end position. Therefore, since the wiper member 821 is separated from the scattering prevention member 84, no liquid remains on the ink ejection surface 361. Further, with the scattering prevention member 84, it is possible to prevent the liquid (the ink or the cleaning liquid) from scattering when the wiper member 821 is separated.

Further, the inclined surface of the cleaning liquid supply device 83 is located upstream in the wiping direction D21 continuously to the cleaning liquid supply surface 865 and is inclined upward with respect to the cleaning liquid supply surface 865 upstream in the wiping direction D21. The movement start position is a position at which the tip of the wiper member 821 is determined in a region immediately below the inclined surface and a region above a plane including the cleaning liquid supply surface 865 in advance. Thereby, the wiper member 821 can be preferably brought into contact with the cleaning liquid supply surface 865 and the ink ejection surface 361.

Further, as control of the overall system air bubble release operation, the controller 100 extrudes the cleaning liquid 831 of an amount of 0.5 times or more and 1 times or more the capacity of the horizontal tubular member 872 from the cleaning liquid supply port 834 multiple times (iA) when the cleaning liquid 831 is extruded from the cleaning liquid supply port 834 multiple times so that the total amount of the multiple-time extrusion becomes 1.5 times or more the capacity of the horizontal tubular member 872. Thereby, all of air bubbles present in the cleaning liquid supply device 83, air bubbles present in the vertical tubular member 871, and air bubbles present in the horizontal tubular member 872 can be extruded together with the cleaning liquid 831, and there can be no air bubbles in the cleaning liquid 831 in the cleaning liquid supply port 834. Further, as control of the overall system air bubble release operation, the controller 100 extrudes the cleaning liquid 831 of an amount of 1.5 time or more the capacity of the horizontal tubular member 872 from the cleaning liquid supply port 834 once (iB) when the cleaning liquid 831 is extruded from the cleaning liquid supply port 834 once. Thereby, all of air bubbles present in the cleaning liquid supply device 83, air bubbles present in the vertical tubular member 871, and air bubbles present in the horizontal tubular member 872 can be extruded together with the cleaning liquid 831, and there can be no air bubbles in the cleaning liquid 831 in the cleaning liquid supply port 834. Further, since the control of the overall system air bubble release operation is not executed each time before the control of the cleaning operation but is executed when a predetermined execution condition is satisfied before the control of the cleaning operation, it is possible to curb the consumption of the cleaning liquid 831. Since the controller 100 (ii) moves the wiper member 821 in the wiping direction D21 and (iii) separates the wiper member 821 from the cleaning liquid supply surface 865, no bubbles remain on the cleaning liquid supply surface 865. Therefore, the control of the air bubble release operation can be preferably executed. After the air bubble release operation, the control of the cleaning operation is performed. That is, since the control of the cleaning operation for wiping the ink ejection surface 361 using the wiper member 821 using the bubble-free cleaning liquid 831 is performed, no bubbles remain on the ink ejection surface 361 of the recording head 36. Thereby, it is possible to reduce the occurrence of image defects due to paper stains.

Further, the control of the overall system air bubble release operation is executed when the number of executions of the control of the cleaning operation reaches the predetermined multiple times. That is, the control of the overall system air bubble release operation is executed once every multiple times. Thereby, it is possible to curb the consumption of the cleaning liquid 831.

Figure 12:
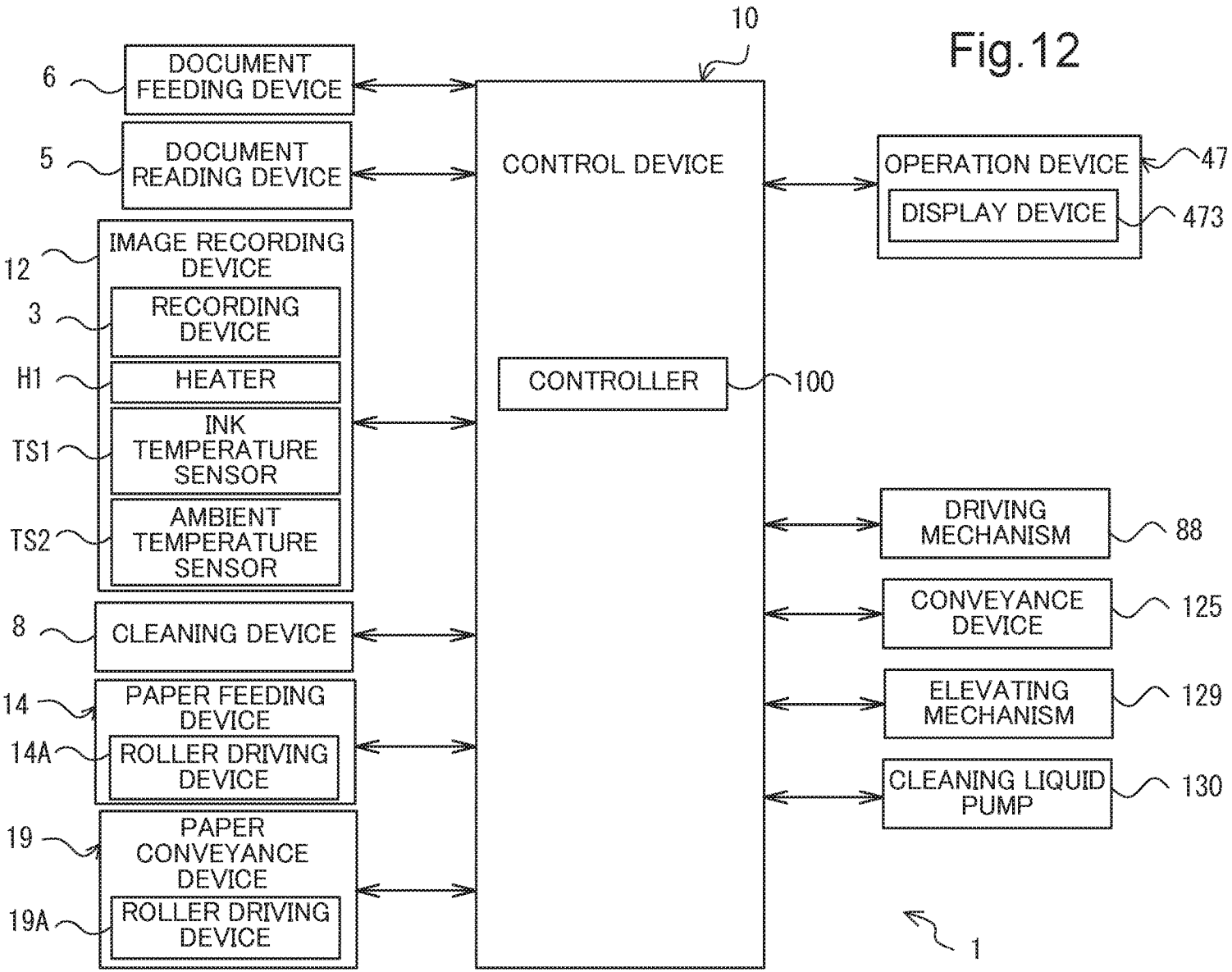
FIG. 12 is a functional block diagram schematically illustrating a main internal configuration of an inkjet recording apparatus according to a second embodiment.

Next, the inkjet recording apparatus 1 according to a second embodiment will be described. FIG. 12 is a functional block diagram schematically illustrating a main internal configuration of the inkjet recording apparatus according to the second embodiment.

Although the control of the overall system air bubble release operation is performed when the number of executions of the control of the cleaning operation reaches the predetermined multiple times (for example, 15 times) in the first embodiment described above, the second embodiment is different from the first embodiment described above in that the control of the overall system air bubble release operation is performed when an ambient temperature of the recording head 36 is lower than an allowable print temperature range (which may be a specific temperature) at the time of power-ON of the inkjet recording apparatus 1 and then the ambient temperature of the recording head 36 reaches the allowable print temperature range at one or multiple times.

The image recording device 12 of the second embodiment further includes a heater H1 capable of heating ink on an ink supply path to the recording head 36, an ink temperature sensor TS1 that detects a temperature of the ink heated by the heater H1, and an ambient temperature sensor TS2 that detects an ambient temperature of the recording head 36, for each of the line heads 31 to 34 illustrated in FIG. 4B, as illustrated in FIG. 12.

The controller 100 determines whether or not the temperature of the ink detected by the ink temperature sensor TS1 is in the allowable print temperature range, permits the recording device 3 to perform printing when the controller 100 determines that the temperature of the ink is in the allowable print temperature range, and determines whether or not the ambient temperature of the recording head 36 detected by the ambient temperature sensor TS2 is in the allowable print temperature range.

The controller 100 performs the control of the overall system air bubble release operation when the ambient temperature of the recording head 36 is lower than the allowable print temperature range at the time of power-ON of the inkjet recording apparatus 1 and then the ambient temperature of the recording head 36 reaches the allowable print temperature range at one or multiple times, as the predetermined execution condition.

Incidentally, in an inkjet recording apparatus in which a recording head is equipped with a heater, an ambient temperature of the recording head (in other words, a temperature inside the apparatus) changes from a low temperature to a high temperature, and becomes higher than an outside temperature even at the time of the low temperature. For an amount of dissolved air as a characteristic of the liquid, a dissolution concentration is high at a low temperature and low at a higher temperature. In this case, when micro air bubbles or the like are present in the cleaning liquid, air bubbles grow large from the micro air bubbles. When a temperature in the cleaning liquid flow path decreases again, the air that has transmitted through the cleaning liquid flow path is dissolved into the cleaning liquid, the cleaning liquid flow path is filled with air bubbles due to repetitive temperature undulation. In the worst case, even when an extrusion operation is performed, a predetermined amount of cleaning liquid does not flow from the cleaning liquid supply port 834, and when this state continues, cleaning failure such as fixed ink remaining on the ink ejection surface 361 occurs. Further, when the cleaning failure occurs, the ink ejection port 371 is clogged (for example, nozzle clogging), white streaks due to instability in flight and drying of the ink in a cap state are faster than a predetermined case, causing image defects due to intermittent discharge failure.

Therefore, the control of the overall system air bubble release operation is executed when the ambient temperature of the recording head 36 is lower than the allowable print temperature range at the time of power-ON of the inkjet recording apparatus 1 and then the ambient temperature of the recording head 36 reaches the allowable print temperature range at one or multiple times. For example, when air bubbles are generated in the cleaning liquid flow path 87 due to temperature undulation, the air bubbles cannot be extruded by mere control of the air bubble release operation as described above. However, according to the second embodiment, when air bubbles are highly likely to be generated in the cleaning liquid flow path 87 due to temperature undulation, it is possible to perform the control of the overall system air bubble release operation, and to extrude all the air bubbles generated in the cleaning liquid flow path 87 due to the temperature undulation. Thereby, cleaning failure can be reduced, and the occurrence of image defects due to intermittent discharge failure can be prevented.

In the second embodiment, when the ambient temperature of the recording head 36 is lower than the allowable print temperature range at the time of power-ON of the inkjet recording apparatus 1, and then, the ambient temperature of the recording head 36 reaches the allowable print temperature range at one or multiple times, the control of the overall system air bubble release operation is performed, but the present invention is not limited thereto. That is, in the second embodiment, when the control of the overall system air bubble release operation is not performed after it is detected that the ambient temperature of the recording head 36 has changed to a predetermined allowable print temperature range, the control of the overall system air bubble release operation may be performed.

Further, the present disclosure is not limited to the configuration of the above embodiment, and various modifications of the present disclosure can be made. Further, although a case in which a multifunction device is used as an embodiment of the inkjet recording apparatus according to the present disclosure has been described in the above embodiment, but this is merely an example. For example, other inkjet recording apparatuses having a printer function may be used.

Further, in the embodiment, the configuration and process described in the embodiment with reference to FIGS. 1 to 12 are only an embodiment of the present disclosure, and the present disclosure is not intended to be limited to the configuration and process.

While the present disclosure has been described in detail with reference to the embodiments there, it would be apparent to those skilled in the art the various changes and modifications may be made therein within the scope defined by the appended claims.

What is claimed is:

1. An inkjet recording apparatus comprising:

a recording head including an ink ejection surface having an ink ejection port from which ink is ejected;

a wiper member configured to move in a predetermined wiping direction in contact with the ink ejection surface to wipe the ink ejection surface;

a cleaning liquid supply device including a cleaning liquid supply surface including a cleaning liquid supply port configured to supply a cleaning liquid to be used for the wiper member to wipe the ink ejection surface, the cleaning liquid supply device being provided upstream of the ink ejection surface in the wiping direction;

a cleaning liquid storage device configured to store the cleaning liquid;

a cleaning liquid flow path configured to guide the cleaning liquid from the cleaning liquid storage device to the cleaning liquid supply device;

a driving device configured to impart power for moving the cleaning liquid in the cleaning liquid flow path and extruding the cleaning liquid from the cleaning liquid supply port; and a control device including a processor and, through the processor executing a control program, functioning as a controller configured to perform control of a cleaning operation for wiping the ink ejection surface with the wiper member using the cleaning liquid, wherein the cleaning liquid flow path includes a vertical tubular member whose one end is connected to the cleaning liquid supply device and, from the one end to an opposite end thereof, extending upwardly of the cleaning liquid supply device, and a horizontal tubular member whose one end is connected to an upper end of the vertical tubular member and, from the one end to an opposite end thereof, extending in a horizontal direction, and the controller performs control of an air bubble release operation of the cleaning liquid flow path by extruding the cleaning liquid in at least a part of the cleaning liquid flow path from the cleaning liquid supply port before the control of the cleaning operation.

2. The inkjet recording apparatus according to claim 1, wherein the recording head is provided more than one for each color, the driving device is provided at an upstream end of the cleaning liquid flow path, the cleaning liquid flow path includes a flow path provided for each of more than one recording head, the flow path including the vertical tubular member and the horizontal tubular member, and each flow path from the driving device to the cleaning liquid supply device provided on the recording head is equal in length.

3. The inkjet recording apparatus according to claim 2, wherein the controller performs, as the control of the air bubble release operation, control for (i) extruding a cleaning liquid of an amount of 0.5 times or more and 0.9 times or less a total capacity of the cleaning liquid supply device and the vertical tubular member from the cleaning liquid supply port and (ii) causing the wiper member to perform wiping in a range including at least a part of the cleaning liquid supply surface and not including the ink ejection surface.

4. The inkjet recording apparatus according to claim 1, wherein the controller further performs control of an overall system air bubble release operation different from the control of the air bubble release operation when a predetermined execution condition is satisfied before the control of the cleaning operation, and the controller performs, as the control of the overall system air bubble release operation, control of (iA) extruding a cleaning liquid of an amount of 0.5 times or more and 1 times or less a capacity of the horizontal tubular member from the cleaning liquid supply port multiple times so that a total amount of the multiple-time extrusion becomes 1.5 times or more the capacity of the horizontal tubular member when the cleaning liquid is extruded from the cleaning liquid supply port multiple times, (iB) extruding a cleaning liquid of an amount of 1.5 times or more the capacity of the horizontal tubular member from the cleaning liquid supply port once when the cleaning liquid is extruded once from the cleaning liquid supply port, and (ii) causing the wiper member to perform wiping in a range including at least a part of the cleaning liquid supply surface and not including the ink ejection surface.

5. The inkjet recording apparatus according to claim 4, wherein the predetermined execution condition is a condition that a number of times of execution of the control of the cleaning operation reaches predetermined multiple times.

6. The inkjet recording apparatus according to claim 4, further comprising:

an ambient temperature sensor configured to detect an ambient temperature of the recording head, wherein the predetermined execution condition is a case in which the ambient temperature sensor detects that the ambient temperature of the recording head has changed from a temperature lower than a predetermined allowable print temperature range to the allowable print temperature range.

7. The inkjet recording apparatus according to claim 4, wherein the controller performs the control of the cleaning operation for wiping the ink ejection surface with the wiper member using the cleaning liquid, and control of an air bubble release operation different from the overall system air bubble release operation, the air bubble release operation being executed when the predetermined execution condition is not satisfied before the control of the cleaning operation, and the controller performs, as the control of the air bubble release operation, control for (i) extruding a cleaning liquid of an amount of 0.5 times or more and 0.9 times or less a total capacity of the cleaning liquid supply device and the vertical tubular member from the cleaning liquid supply port and (ii) causing the wiper member to perform wiping in a range including at least a part of the cleaning liquid supply surface and not including the ink ejection surface.

8. The inkjet recording apparatus according to claim 4, wherein the horizontal tubular member further includes a check valve configured to guide the cleaning liquid in a direction of the vertical tubular member.

9. The inkjet recording apparatus according to claim 4, further comprising:

a scattering prevention member provided downstream of the ink ejection surface in the wiping direction, the wiper member coming into contact with the scattering prevention member after the wiper member wipes the ink ejection surface, wherein the controller performs, as the control of the cleaning operation, control for extruding purge ink from the ink discharge port of the recording head, extruding the cleaning liquid from the cleaning liquid supply port, and moving the wiper member in the wiping direction from the cleaning liquid supply surface to an end position via the ink ejection surface, the end position being a position at which contact with the scattering prevention member occurs.

10. The inkjet recording apparatus according to claim 9, wherein the scattering prevention member has an inclined surface with which the wiper member comes into contact after the wiper member wipes the ink ejection surface.

* * * * *